US008622495B2

(12) United States Patent
Korogi

(10) Patent No.: US 8,622,495 B2
(45) **Date of Patent: *Jan. 7, 2014**

(54) PAPER FLOATING DETECTION APPARATUS AND INKJET RECORDING APPARATUS

(75) Inventor: Yutaka Korogi, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 271 days.

This patent is subject to a terminal disclaimer.

(21) Appl. No.: 13/049,031

(22) Filed: Mar. 16, 2011

(65) Prior Publication Data

US 2011/0227985 A1 Sep. 22, 2011

(30) Foreign Application Priority Data

Mar. 17, 2010 (JP) ..... 2010-060918

(51) Int. Cl.
*B41J 29/38* (2006.01)
*B41J 25/308* (2006.01)
*B41J 2/01* (2006.01)

(52) U.S. Cl.
USPC ..... 347/8; 347/16; 347/101

(58) Field of Classification Search
USPC ..... 347/4, 8, 16, 19, 101
See application file for complete search history.

(56) References Cited

U.S. PATENT DOCUMENTS

2012/0050373 A1* 3/2012 Korogi et al. ..... 347/16

FOREIGN PATENT DOCUMENTS

DE 199 06 343 A1 9/1999
JP 2004-299155 A 10/2004
JP 2007-76109 A 3/2007
JP 2007-98650 A 4/2007
JP 2008-126155 A 6/2008
JP 2010-76872 A 4/2010

OTHER PUBLICATIONS

US Office Action, dated Sep. 24, 2013, for U.S. Appl. No. 13/221,555.

* cited by examiner

*Primary Examiner* — Jason Uhlenhake
(74) *Attorney, Agent, or Firm* — Birch, Stewart, Kolasch & Birch, LLP

(57) ABSTRACT

A paper floating detection apparatus which detects floating of paper conveyed along a prescribed conveyance path on a prescribed conveyance surface, includes: a paper floating detection device which includes a light emission unit and a light reception unit disposed so as to be mutually opposing across the conveyance path, and detects whether the paper floats or not according to whether a detection beam emitted parallel to the conveyance surface from the light emission unit toward the light reception unit in a position at a prescribed height from the conveyance surface is received by the light reception unit or not; a light emission parallel flat plate which is disposed in front of the light emission unit in such a manner that the detection beam emitted from the light emission unit passes through the light emission parallel flat plate, and which is provided rotatably about an axis parallel to the conveyance surface and perpendicular to the detection beam in such a manner that the height of the detection beam emitted from the light emission parallel flat plate after passing inside the light emission parallel flat plate varies according to rotation of the light emission parallel flat plate; and a light emission parallel flat plate rotation driving device which drives the rotation of the light emission parallel flat plate.

17 Claims, 14 Drawing Sheets

(+)

(0)

(−)

PAPER FLOATING DETECTION APPARATUS AND INKJET RECORDING APPARATUS

BACKGROUND OF THE INVENTION

1. Field of the Invention

The present invention relates to a paper floating detection apparatus and to an inkjet recording apparatus, and more particularly to a paper floating detection apparatus and an inkjet recording apparatus, allowing the detection height of floating paper to be varied.

2. Description of the Related Art

In an inkjet recording apparatus, a prescribed image is recorded on a recording surface of paper by ejecting ink droplets from an inkjet head onto paper which is conveyed along a predetermined conveyance path. In an inkjet recording apparatus of this kind, if the conveyed paper floats up from the conveyance surface, then there are possibilities that the distance from the nozzle surface of the head to the recording surface of the paper (the throw distance) changes, the recording quality declines, the paper rubs against the nozzle surface of the head and the nozzle surface becomes damaged. Consequently, in an inkjet recording apparatus, a paper floating detection apparatus is disposed in the paper conveyance path and if floating of a specified value or more is detected, then processing, such as halting conveyance, or the like, is implemented.

In general, floating up of paper has been detected by disposing a light emitting unit and a light reception unit in mutually opposing fashion across the paper conveyance path, emitting a detection beam from the light emitting unit toward the light reception unit in a position at a predetermined height from the conveyance surface, and detecting whether or not the detection beam is received. In other words, when floating of the paper occurs, the paper shields reception of the detection beam, and hence the presence or absence of floating of the paper is judged on this basis (see, for example, Japanese Patent Application Publication No. 2007-76109 and Japanese Patent Application Publication No. 2007-98650).

Papers which are recorded by an inkjet recording apparatus include papers of various different thicknesses. Therefore, if the thickness of the paper used has changed, it is necessary to change the floating detection height in accordance with this paper thickness.

Japanese Patent Application Publication No. 2004-299155 proposes technology in which a light emitting unit and a light reception unit are provided on a member that is raised and lowered together with an inkjet head, and a floating detection height is changed in accordance with the raising or lowering of the inkjet head.

However, in the technology described in Japanese Patent Application Publication No. 2004-299155, there is a possibility that fine adjustment is difficult due to the composition which alters the detection height by raising and lowering the inkjet head.

Furthermore, if the inkjet head is twisted, then positional displacement occurs between the light emitting unit and the light reception unit, and hence there is a possibility that the detection accuracy falls.

Moreover, in an apparatus which carries out maintenance by moving an inkjet head periodically to a maintenance unit, discrepancy may occur in the detection height each time the inkjet head is moved, and hence there is a possibility that highly accurate detection cannot be carried out in a stable fashion.

Furthermore, a light emitting unit and a light reception unit are provided below the inkjet head, and therefore when the inkjet head is withdrawn, the withdrawal amount is required to be made large and hence there is a possibility that the apparatus becomes large in size.

SUMMARY OF THE INVENTION

The present invention has been contrived in view of these circumstances, an object thereof being to provide a paper floating detection apparatus and an inkjet recording apparatus whereby the floating detection height can be adjusted with high accuracy and highly accurate detection can be performed stably.

In order to attain an object described above, one aspect of the present invention is directed to a paper floating detection apparatus which detects floating of paper conveyed along a prescribed conveyance path on a prescribed conveyance surface, the paper floating detection apparatus comprising: a paper floating detection device which includes a light emission unit and a light reception unit disposed so as to be mutually opposing across the conveyance path, and detects whether the paper floats or not according to whether a detection beam emitted parallel to the conveyance surface from the light emission unit toward the light reception unit in a position at a prescribed height from the conveyance surface is received by the light reception unit or not; a light emission parallel flat plate which is disposed in front of the light emission unit in such a manner that the detection beam emitted from the light emission unit passes through the light emission parallel flat plate, and which is provided rotatably about an axis parallel to the conveyance surface and perpendicular to the detection beam in such a manner that the height of the detection beam emitted from the light emission parallel flat plate after passing inside the light emission parallel flat plate varies according to rotation of the light emission parallel flat plate; and a light emission parallel flat plate rotation driving device which drives the rotation of the light emission parallel flat plate.

According to this aspect of the invention, by rotating the parallel flat plate for light emission which is disposed in front of the light emission unit, it is possible to alter the height for detecting floating of paper (namely, the height of the detection beam from the conveyance surface). If the parallel flat plate for light emission is inclined with respect to the optical axis of the detection beam, then due to the effects of refraction, the emission position of the detection beam emitted from the parallel flat plate for light emission is shifted upwards or downwards. The emission position of the detection beam is displaced in accordance with the angle of incidence of the detection beam which is incident on the parallel flat plate for light emission, and the angle of incidence varies with the amount of rotation of the parallel flat plate for light emission. Therefore, by rotating the parallel flat plate for light emission, it is possible to change the emission position of the detection beam and hence to alter the height of the detection beam (the detection height for floating of the paper). By using the refraction action of a parallel flat plate for light emission in this way to shift the optical axis of a detection beam, it is possible to adjust the detection height for floating simply and accurately. Furthermore, since the detection apparatus is not dependent on other compositional elements, it is possible to achieve stable detection over a long period of time.

Desirably, the paper floating detection apparatus further comprises: a light reception parallel flat plate which is disposed in front of the light reception unit in such a manner that the detection beam having passed through the light emission parallel flat plate passes through the light reception parallel flat plate, and which is provided rotatably about an axis parallel to the conveyance surface and perpendicular to the detection beam in such a manner that the height of the detection beam emitted from the light reception parallel flat plate after passing inside the light reception parallel flat plate varies according to rotation of the light reception parallel flat plate; and a light reception parallel flat plate rotation driving device which drives the rotation of the light reception parallel flat plate.

According to this aspect of the invention, the parallel flat plate for light reception is provided on the light reception side, allowing the height of the detection beam to be adjusted. With such a plate, more accurate detection can be accomplished.

Desirably, an aperture for light reception is disposed between the light reception unit and the light reception parallel flat plate.

According to this aspect of the invention, an aperture (aperture for light reception) is provided between the light reception unit and the parallel flat plate for light reception. By this means, even if there is some positional discrepancy between the light emission unit and the light reception unit, the position of the optical axis of the detection beam can be specified by the aperture, and therefore it is possible to achieve a highly robust structure.

Desirably, an aperture for light emission is disposed between the light emission unit and the light emission parallel flat plate.

According to this aspect of the invention, an aperture (aperture for light emission) is also provided between the light emission unit and the parallel flat plate for light emission. By this means, it is possible to achieve even more accurate detection of floating.

Desirably, an opening surface area of the aperture for light reception is set to be smaller than an opening surface area of the aperture for light emission.

According to this aspect of the invention, the opening surface area of the aperture for light reception is set to be smaller than the opening surface area of the aperture for light emission. By this means, it is possible to extremely reduce the effects of the introduction of reflected light, and therefore detection of high accuracy can be performed.

Desirably, the paper floating detection apparatus further comprises a detection height adjustment device which controls driving of the light emission parallel flat plate rotation driving device according to a detection result of the paper floating detection device, so as to adjust the height of the detection beam, wherein the detection height adjustment device performs an operation of: causing the light emission parallel flat plate to rotate in a first direction in a state where the detection beam is received by the light reception unit, halting the rotation of the light emission parallel flat plate when the detection beam is no longer received by the light reception unit and employing, as a reference position, a position of the light emission parallel flat plate when the rotation of the light emission parallel flat plate is halted, and causing the light emission parallel flat plate to rotate by a prescribed amount from the reference position in a second direction which is opposite to the first direction so as to adjust the height of the detection beam.

According to this aspect of the invention, since the height of the detection beam (the detection height for floating of paper) is set by detecting the position of the conveyance surface as a reference for positional adjustment, then it is possible to set the detection height for floating of paper with high accuracy.

Desirably, the paper floating detection apparatus further comprises a detection height adjustment device which controls driving of the light emission parallel flat plate rotation driving device and the light reception parallel flat plate rotation driving device according to a detection result of the paper floating detection device, so as to adjust the height of the detection beam, wherein the detection height adjustment device performs an operation of: causing the light emission parallel flat plate to rotate in a first direction in a state where the detection beam is received by the light reception unit, and halting the rotation of the light emission parallel flat plate when the detection beam is no longer received by the light reception unit, and rotating the light emission parallel flat plate by a prescribed amount in a second direction which is opposite to the first direction, then causing the light reception parallel flat plate to rotate in the second direction, and halting the rotation of the light reception parallel flat plate when the detection beam is no longer received by the light reception unit, and employing, as reference positions, positions of the light emission parallel flat plate and the light reception parallel flat plate when the rotation of the light reception parallel flat plate is halted, and causing the light reception parallel flat plate to rotate by a prescribed amount from the reference position in the first direction and causing the light emission parallel flat plate to rotate by a prescribed amount from the reference position in the second direction so as to adjust the height of the detection beam.

According to this aspect of the invention, since the height of the detection beam (the detection height for floating of paper) is set by detecting the position of the conveyance surface as a reference for positional adjustment, then it is possible to set the detection height for floating of paper with high accuracy.

Desirably, the detection height adjustment device starts the operation from a prescribed start position for light emission, and the paper floating detection apparatus further comprises: a light emission reference rotation amount detection device which detects, as a light emission reference rotation amount, an amount of the rotation of the light emission parallel flat plate from the start position for light emission to the reference position; and an abnormality judgment device which compares the light emission reference rotation amount detected by the light emission reference rotation amount detection device with a threshold value so as to judge whether there is an apparatus abnormality.

According to this aspect of the invention, the amount of rotation of the parallel flat plate for light emission from a prescribed light emission start position to a reference position is detected as a light emission reference rotation amount, and an apparatus abnormality is judged on the basis of this light emission reference rotation amount. By this means, it is possible to prevent an apparatus abnormality in advance, and stable detection can be performed.

Desirably, the detection height adjustment device starts the operation from a prescribed start position for light emission and a prescribed start position for light reception, and the paper floating detection apparatus further comprises: a light emission reference rotation amount detection device which detects, as a light emission reference rotation amount, an amount of the rotation of the light emission parallel flat plate from the start position for light emission to the reference position; a light reception reference rotation amount detection device which detects, as a light reception reference rotation amount, an amount of the rotation of the light reception parallel flat plate from the start position for light reception to the reference position; and an abnormality judgment device which compares the light emission reference rotation amount detected by the light emission reference rotation amount detection device with a threshold value and compares the light reception reference rotation amount detected by the light reception reference rotation amount detection device with a threshold value so as to judge whether or not there is an apparatus abnormality.

According to this aspect of the invention, the amount of rotation of the parallel flat plate for light emission from a prescribed light emission start position to a reference position is detected as a light emission reference rotation amount, the amount of rotation of the parallel flat plate for light reception from a prescribed light reception start position to a reference position is detected as a light reception reference rotation amount, and an apparatus abnormality is judged on the basis of the light emission reference rotation amount and the light reception reference rotation amount. By this means, it is possible to prevent an apparatus abnormality in advance, and stable detection can be performed.

Desirably, the detection height adjustment device repeats the operation a plurality of times so as to adjust the height of the detection beam.

According to this aspect of the invention, the height of the detection beam is adjusted by repeating an adjustment operation of the height position of the detection beam a plurality of times. By this means, it is possible to achieve even more accurate adjustment.

Desirably, the light emission unit and the light reception unit are disposed in such a manner that the detection beam emitted from the light emission unit toward the light reception unit is inclined at a prescribed angle with respect to a direction perpendicular to a conveyance direction of the paper.

According to this aspect of the invention, the light emission unit and the light reception unit are arranged in such a manner that the detection beam emitted from the light emission unit toward the light reception unit is inclined at a prescribed angle (0.3° to 2° inclination) with respect to the direction perpendicular to the conveyance direction of the paper. By this means, it is also possible to detect the floating in a direction perpendicular to the conveyance direction of the paper, with good accuracy.

In order to attain an object described above, another aspect of the present invention is directed to an inkjet recording apparatus comprising: a conveyance device which conveys paper; an inkjet head which ejects droplets of ink onto a recording surface of the paper conveyed by the conveyance device to form an image; any one of the above paper floating detection apparatuses which is disposed on an upstream side of the inkjet head and detects the floating of the paper from the conveyance surface of the conveyance device; and a conveyance abnormality judgment device which judges a conveyance abnormality of the paper according to a detection result of the paper floating detection apparatus.

According to this aspect of the invention, a paper floating detection apparatus is incorporated into an inkjet recording apparatus and floating of paper during recording is detected by the paper floating detection apparatus.

Desirably, the conveyance device is a conveyance drum which holds the paper by suction on an outer circumferential surface of the conveyance drum and conveys the paper by rotating.

According to this aspect of the invention, floating of paper conveyed by a conveyance drum is detected.

Desirably, the inkjet head is provided movably between an image formation position where the droplets of ink are ejected onto the recording surface of the paper conveyed by the conveyance device to form the image and a withdrawn position where the inkjet head is withdrawn from the conveyance device, and the paper floating detection apparatus raises the height of the detection beam by a prescribed amount of height or halts detection, when the inkjet head is moved to the withdrawn position.

According to this aspect of the invention, when the inkjet head is moved to a withdrawn position, the height of the detection beam produced by the paper floating detection apparatus (the detection height for floating of paper) is raised by a prescribed amount. Alternatively, detection of floating of the paper by the paper floating detection apparatus is halted. By this means, detection errors can be prevented.

Desirably, the paper floating detection apparatus raises the height of the detection beam by a prescribed amount of height or halts detection, when recording is halted.

According to this aspect of the invention, when recording is halted, the height of the detection beam produced by the paper floating detection apparatus (the detection height for floating of paper) is raised by a prescribed amount. Alternatively, detection of floating of the paper by the paper floating detection apparatus is halted. By this means, detection errors can be prevented.

According to the present invention, it is possible to adjust the detection height for floating with high accuracy, and highly accurate detection of the floating can be performed in a stable fashion.

BRIEF DESCRIPTION OF THE DRAWINGS

A preferred embodiment of this invention as well as other objects and benefits thereof, will be explained in the following with reference to the accompanying drawings, in which like reference characters designate the same or similar parts throughout the figures and wherein.

DESCRIPTION OF THE PREFERRED EMBODIMENTS

General Composition

Figure 1:
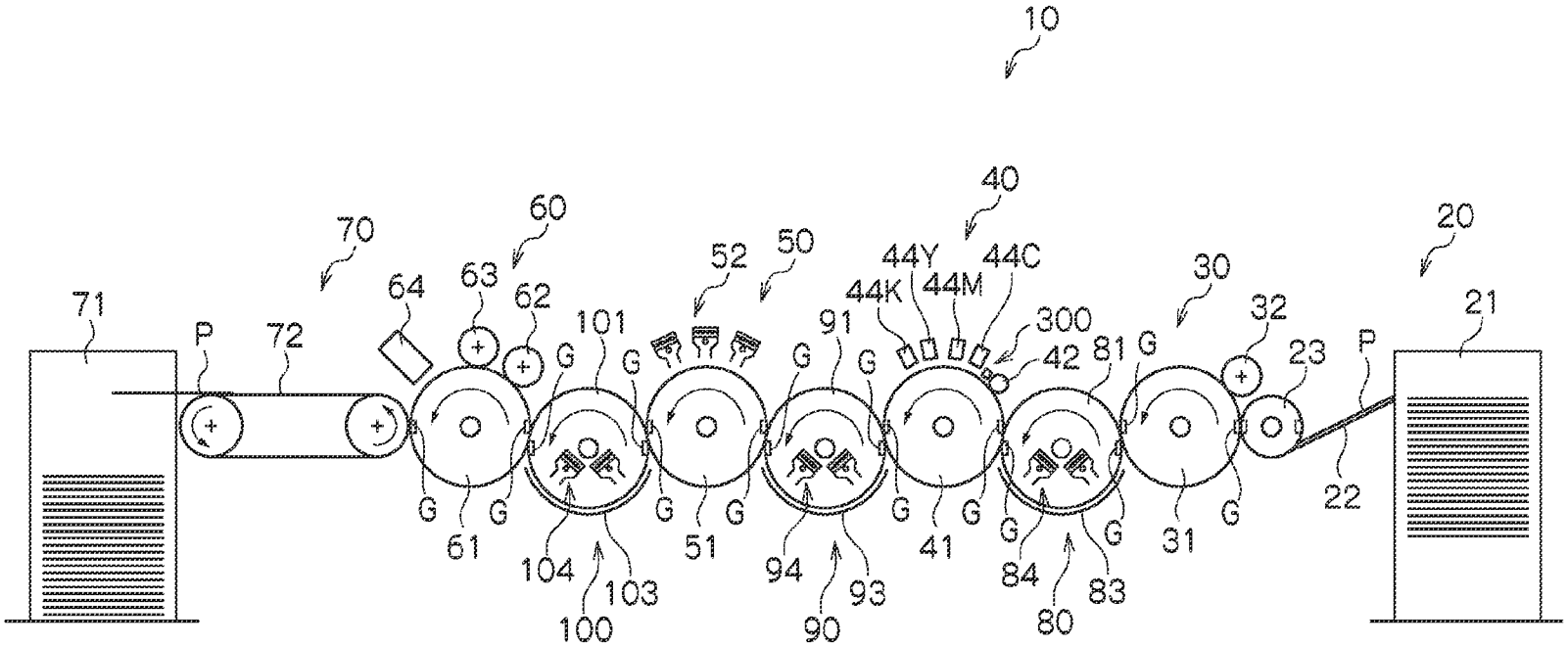
FIG. 1 is a schematic drawing showing the general composition of an inkjet recording apparatus to which an embodiment of the present invention is applied.

FIG. 1 is schematic drawing showing the general composition of an inkjet recording apparatus into which a paper floating detection apparatus according to an embodiment of the present invention is incorporated.

The inkjet recording apparatus 10 shown in FIG. 1 is a recording apparatus which performs printing by an inkjet method onto cut sheet paper P, using an aqueous ink (ink including water in the solvent), and includes a paper supply unit 20 which supplies paper P, a treatment liquid deposition unit 30 which deposits a prescribed treatment liquid onto a recording surface of the paper P, an image recording unit 40 which forms a color image by ejecting droplets of ink of the respective colors of C (cyan), M (magenta), Y (yellow) and K (black) onto a recording surface of the paper P, from an inkjet head, an ink drying unit 50 which dries the ink droplets that have been ejected onto the paper P, a fixing unit 60 which fixes the image recorded on the paper P, and a recovery unit 70 which recovers paper P after printing.

Conveyance drums 31, 41, 51, 61 are provided respectively as conveyance devices of the paper P, in the treatment liquid deposition unit 30, the image recording unit 40, the ink drying unit 50 and the fixing unit 60. The paper P is conveyed through the treatment liquid deposition unit 30, the image recording unit 40, the ink drying unit 50 and the fixing unit 60, by means of these conveyance drums 31, 41, 51, 61.

The conveyance drums 31, 41, 51, 61 are formed to correspond to the paper width and rotate by being driven by motors (not illustrated) (in FIG. 1, the drums rotate in the counterclockwise direction). Grippers G are provided on the circumferential surface of each conveyance drum 31, 41, 51, 61, and the paper P is conveyed with the leading end portion thereof being gripped by a gripper G. In the present embodiment, a composition is adopted in which grippers G are provided at two positions (separated by 180°) on the circumferential surface of each conveyance drum 31, 41, 51, 61, in such a manner that two sheets of paper can be conveyed in one revolution.

Moreover, a lot of suction holes are formed in each of the circumferential surfaces of the conveyance drums 31, 41, 51, 61, and the rear surface of the paper P is vacuum suctioned via these suction holes, thereby holding the paper P by suction on the circumferential surfaces of the conveyance drums 31, 41, 51, 61. In the present embodiment, a composition is adopted in which the paper P is vacuum suctioned and held by suction on the outer circumferential surfaces of the conveyance drums 31, 41, 51, 61, but it is also possible to adopt a composition in which the paper P is attracted electrostatically and held by attraction on the outer circumferential surfaces of the conveyance drums 31, 41, 51, 61.

Transfer drums 80, 90, 100 are disposed respectively between the treatment liquid deposition unit 30 and the image recording unit 40, between the image recording unit 40 and the ink drying unit 50, and between the ink drying unit 50 and the fixing unit 60. The paper P is conveyed between the respective units by means of these transfer drums 80, 90, 100.

The transfer drums 80, 90, 100 are composed by transfer drum main bodies 81, 91, 101 constituted by frames, and grippers G which are provided on the transfer drum main bodies 81, 91, 101. The transfer drum main bodies 81, 91, 101 are formed to correspond to the paper width and rotate by being driven by motors (not illustrated) (in FIG. 1, the drums rotate in the clockwise direction). By this means, the grippers G rotate on the same circular path. The paper P is conveyed with the leading end portion thereof being gripped by a gripper G. In the present embodiment, a pair of grippers G is arranged at symmetrical positions about the axis of rotation, in such a manner that two sheets of paper can be conveyed in one revolution.

Circular arc-shaped guide plates 83, 93, 103 are arranged along the conveyance path of the paper P, below the transfer drums 80, 90, 100 respectively. The paper P which is conveyed by the transfer drums 80, 90, 100 is conveyed while the rear surface of the paper (the surface on the opposite side to the recording surface) is guided by the guide plates 83, 93, 103.

Furthermore, driers 84, 94, 104 which blow a hot air flow toward the paper P conveyed by the transfer drum 80 are arranged inside the transfer drums 80, 90, 100. The hot air flows blown out from the driers 84, 94, 104 during this conveyance process strike the recording surface of the paper P conveyed by the transfer drums 80, 90, 100.

The paper P supplied from the paper supply unit 20 is transferred to the conveyance drum 31 of the treatment liquid deposition unit 30, and is then transferred from the conveyance drum 31 of the treatment liquid deposition unit 30 to the conveyance drum 41 of the image recording unit 40 via the transfer drum 80. The paper P is transferred from the conveyance drum 41 of the image recording unit 40 to the conveyance drum 51 of the ink drying unit 50 via the transfer drum 90, and is transferred from the conveyance drum 51 of the ink drying unit 50 to the conveyance drum 61 of the fixing unit 60 via the transfer drum 100. The paper is then transferred from the conveyance drum 61 of the fixing unit 60 to the recovery unit 70. While passing through this series of conveyance steps, required processes are carried out and an image is formed on the recording surface of the paper P.

The paper P is conveyed in such a manner that the recording surface is facing toward the outside on the conveyance drums 31, 41, 51, 61, and the recording surface is facing toward the inside on the transfer drums 80, 90, 100.

The composition of the respective units of the inkjet recording apparatus 10 according to the present embodiment is described in detail below.

Paper Supply Unit

The paper supply unit 20 includes a paper supply device 21, a paper supply tray 22 and a transfer drum 23, and supplies cut sheet paper P continuously, one sheet at a time, to the treatment liquid deposition unit 30.

The paper supply device 21 supplies paper P stacked in a magazine (not illustrated), successively, one sheet at a time from the upper side, to the paper supply tray 22.

The paper supply tray 22 outputs the paper P supplied from the paper supply device 21, to the transfer drum 23.

The transfer drum 23 receives the paper P output from the paper supply tray 22, conveys the paper along a prescribed conveyance path, and then transfers the paper to the conveyance drum 31 of the treatment liquid deposition unit 30.

Versatile recording paper, which is not exclusively produced for inkjet printing, is used as the paper P.

Treatment Liquid Deposition Unit

The treatment liquid deposition unit 30 deposits a prescribed treatment liquid onto the recording surface of the paper P. The treatment liquid deposition unit 30 includes a conveyance drum which conveys the paper P (called "treatment liquid deposition drum" below) 31, and a treatment liquid deposition apparatus 32 which deposits a prescribed treatment liquid onto the recording surface of the paper P conveyed by the treatment liquid deposition drum 31.

The treatment liquid deposition drum 31 receives paper P from the transfer drum 23 of the paper supply unit 20 (by gripping the leading end of the paper P with a gripper G), and conveys the paper P by rotating.

The treatment liquid deposition apparatus 32 deposits treatment liquid having a function of aggregating the coloring material in the ink, onto the recording surface of the paper P conveyed by the treatment liquid deposition drum 31. In this treatment liquid deposition apparatus 32, for example, the treatment liquid deposition apparatus 32 is constituted as a coating apparatus for applying treatment liquid by a roller which applies treatment liquid to the recording surface of the paper P by abutting and pressing a coating roller bearing treatment liquid on the circumferential surface thereof against the surface of the paper P. By previously depositing treatment liquid of this kind and then ejecting droplets of ink, it is possible to suppress feathering, bleeding, and the like, and to perform recording of high quality, even when using generic recording paper. For the treatment liquid deposition apparatus 32, it is possible to adopt a composition which deposits a treatment liquid by using a droplet ejection head similar to the inkjet head described below, or a composition which deposits a treatment liquid by means of a spray.

According to the treatment liquid deposition unit 30 having the composition described above, the paper P is conveyed along a prescribed conveyance path by the treatment liquid deposition drum 31, and during this conveyance process, treatment liquid is deposited onto the recording surface from the treatment liquid deposition apparatus 32. The paper P having treatment liquid deposited on the recording surface thereof is then transferred from the treatment liquid deposition drum 31 to the transfer drum 80 at a prescribed position.

Here, as described above, a drier 84 is arranged inside the transfer drum 80, and a hot air flow is blown toward the guide plate 83. A hot air flow is blown onto the recording surface of the paper P in the course of the conveyance of the paper from the treatment liquid deposition unit 30 to the image recording unit 40 by the transfer drum 80, thereby drying the treatment liquid which has been deposited on the recording surface (namely, evaporating off the solvent component in the treatment liquid).

Image Recording Unit

The image recording unit 40 forms a color image on the recording surface of the paper P by ejecting ink droplets of the respective colors of C, M, Y, K onto the recording surface of the paper P. The image recording unit 40 includes: a conveyance drum 41 which conveys paper P (hereinafter, called "image recording drum"), a paper pressing roller 42 which presses against the recording surface of the paper P conveyed by the image recording drum 41, thereby causing the rear surface of the paper P to make close contact with the circumferential surface of the image recording drum 41, a paper floating detection apparatus 300 which detects floating of the paper P having passed the paper pressing roller 42, and inkjet heads 44C, 44M, 44Y, 44K which eject ink droplets of respective colors of C, M, Y, K onto the paper P.

The image recording drum 41 receives paper P from the transfer drum 80 and conveys the paper P by rotating. In this step, as described above, the paper P is conveyed by being held by suction on the outer circumferential surface of the image recording drum 41. Therefore, a circular arc-shaped surface demarcated by the outer circumferential surface of the image recording drum 41 (the region from where the paper P is received from the transfer drum 80 to where the paper P is transferred to the transfer drum 90) is formed as a conveyance surface, and the paper P is conveyed along a conveyance path set on this conveyance surface. The conveyance path is set in accordance with the width of the paper P and passing through the center of the image recording drum 41.

The paper pressing roller 42 is disposed in the vicinity of the paper receiving position of the image recording drum 41 (the position where paper P is received from the transfer drum 80), and is abutted and pressed against the circumferential surface of the image recording drum 41 by receiving a pressing force from a pressing mechanism, which is not illustrated. The paper P transferred from the transfer drum 80 to the image recording drum 41 is nipped by passing the paper pressing roller 42 and the rear surface of the paper is thereby caused to make close contact with the outer circumferential surface of the image recording drum 41

The paper floating detection apparatus 300 detects floating of the paper P having passed the paper pressing roller 42 (a prescribed amount of floating or more from the outer circumferential surface of the image recording drum 41). This paper floating detection apparatus 300 detects floating of the paper P by irradiating laser light (a detection beam) across the image recording drum 41 at a position a predetermined height from the outer circumferential surface (conveyance surface) of the image recording drum 41, and detecting the presence or absence of shielding of the light. In other words, if floating of the paper P occurs, then the laser light is shielded by the paper P, and therefore floating of the paper P is detected by detecting the presence or absence of shielding of the laser light. The composition of this paper floating detection apparatus 300 is described in detail hereinafter.

The four inkjet heads 44C, 44M, 44Y, 44K are disposed after the paper floating detection apparatus 300 and are arranged at uniform intervals along the conveyance path of the paper P. The inkjet heads 44C, 44M, 44Y, 44K are each constituted by a line head corresponding to the paper width and eject ink droplets of the corresponding color toward the image recording drum 41 from a nozzle row formed on the nozzle surface.

According to the image recording unit 40 having the composition described above, the paper P is conveyed along a prescribed conveyance path by the image recording drum 41. The paper P transferred from the transfer drum 80 to the image recording drum 41 is firstly nipped by the paper pressing roller 42 and caused to make close contact with the outer circumferential surface of the image recording drum 41. Thereupon, the presence or absence of floating is detected by the paper floating detection apparatus 300, whereupon ink droplets of respective colors of C, M, Y, K are ejected onto the recording surface from the inkjet heads 44C, 44M, 44Y, 44K, thereby forming a color image on the recording surface.

Here, in the inkjet recording apparatus 10 according to the present embodiment, an aqueous ink composed by an ink in which a thermoplastic resin has been dispersed is used for each color. Even if using an aqueous ink of this kind, since a predetermined treatment liquid is deposited on the paper P, then it is possible to perform recording of high quality without giving rise to feathering, bleeding, or the like.

Furthermore, if floating of the paper P is detected by the paper floating detection apparatus 300, then conveyance is halted and a warning is issued.

The paper P on which an image is formed is transferred onto the transfer drum 90, is conveyed on a prescribed conveyance path by the transfer drum 90, and is transferred onto the conveyance drum 51 of the ink drying unit 50. As described above, a drier 94 is arranged inside the transfer drum 90, and a hot air flow is blown toward the guide plate 93. An ink drying process is carried out in an ink drying unit 50 at a later stage, but the paper P also undergoes a drying process during conveyance by the transfer drum 90.

Although not shown in the drawings, a maintenance unit which performs maintenance of the inkjet heads 44C, 44M, 44Y, 44K is provided in the image recording unit 40, and the inkjet heads 44C, 44M, 44Y, 44K are moved to the maintenance unit as and when necessary so as to be able to receive required maintenance.

Ink Drying Unit

The ink drying unit 50 dries the liquid component remaining on the paper P after image recording. This ink drying unit 50 includes a conveyance drum (hereinafter, called "ink drying drum") 51 which conveys the paper P, and an ink drying apparatus 52 which carries out a drying process on the paper P conveyed by the ink drying drum 51.

The ink drying drum 51 receives the paper P from the transfer drum 90 and conveys the paper P by rotating.

The ink drying apparatus 52 is constituted by a drier (in this embodiment, three dryers are provided along the conveyance path for the paper P), for example, and dries the ink (evaporates off the liquid component present on the paper) by blowing a hot air flow toward the paper P conveyed by the ink drying drum 51.

In the ink drying unit 50 having the composition described above, the paper P is conveyed on the ink drying drum 51. In the course of this conveyance, a hot air flow is blown from the ink drying apparatus 52 onto the recording surface and the ink which has been deposited on the recording surface is dried.

The paper P which has passed through the ink drying apparatus 52 is subsequently received onto the transfer drum 100 from the ink drying drum 51 at a prescribed position. The paper P is conveyed on a prescribed conveyance path by the transfer drum 100 and is transferred to the conveyance drum 61 of the fixing unit 60.

As described above, a drier 104 is disposed inside the transfer drum 100 and blows a hot air flow toward the guide plate 103. Consequently, the paper P undergoes a drying process during the conveyance on the transfer drum 100.

Fixing Unit

The fixing unit 60 fixes the image which has been recorded on the recording surface, by applying heat and pressure to the paper P. The fixing unit 60 includes a conveyance drum which conveys paper P (hereinafter called "fixing drum") 61, heat rollers 62, 63 which apply a heating and pressurization process to the paper P conveyed by the fixing drum 61, and an in-line sensor 64 which determines the temperature and humidity, and the like, of the paper P after recording and which captures the recorded image.

The fixing drum 61 receives the paper P from the transfer drum 100 and conveys the paper P by rotating.

The heat rollers 62, 63 heat and pressurize the ink that has been deposited onto the recording surface of the paper P, thereby melting the thermoplastic resin dispersed in the ink and causing the ink to form a film. Furthermore, deformation such as cockling, curl, and the like, which has occurred in the paper P is also corrected simultaneously with this. The heat rollers 62, 63 are formed to substantially the same width as the fixing drum 61, and are heated to a prescribed temperature by the heaters provided therein. Furthermore, the heat rollers 62, 63 are abutted and pressed against the circumferential surface of the fixing drum 61 with a prescribed pressing force, by means of a pressurizing device, which is not illustrated. When the paper P passes the heat rollers 62, 63, the paper P is heated and pressurized by the heat rollers 62, 63.

The in-line sensor 64 includes a temperature meter, a humidity meter, and a CCD line sensor, and the like, and determines the temperature and humidity, and the like, of the paper P conveyed by the fixing drum 61, as well as capturing the image recorded on the paper P. Apparatus abnormalities and head ejection defects, and the like, are checked on the basis of the determination results of the in-line sensor 64.

According to the fixing unit 60 having the composition described above, the paper P is conveyed by the fixing drum 61, and the heat rollers 62, 63 are abutted and pressed against the recording surface in the course of this conveyance, thereby applying heat and pressure to the paper. By this means, the thermoplastic resin dispersed in the ink is melted and the ink forms a film. Furthermore, simultaneously with this, the deformation which has occurred in the paper P is corrected.

The paper P which has undergone the fixing process is transferred from the fixing drum 61 to the recovery unit 70 at a prescribed position.

Recovery Unit

The recovery unit 70 recovers the paper P which has undergone the series of recording processes, in a stacked fashion in a stacker 71. The recovery unit 70 includes the stacker 71 which recovers paper P, and a paper output conveyor 72 which receives paper P that has undergone the fixing process in the fixing unit 60, from the fixing drum 61, conveys the paper P on a prescribed conveyance path, and outputs the paper to the stacker 71.

The paper P which has undergone the fixing process in the fixing unit 60 is transferred onto the paper output conveyor 72 from the fixing drum 61, conveyed by the paper output conveyor 72 up to the stacker 71, and then recovered in the stacker 71.

Conveyance System

Figure 2:
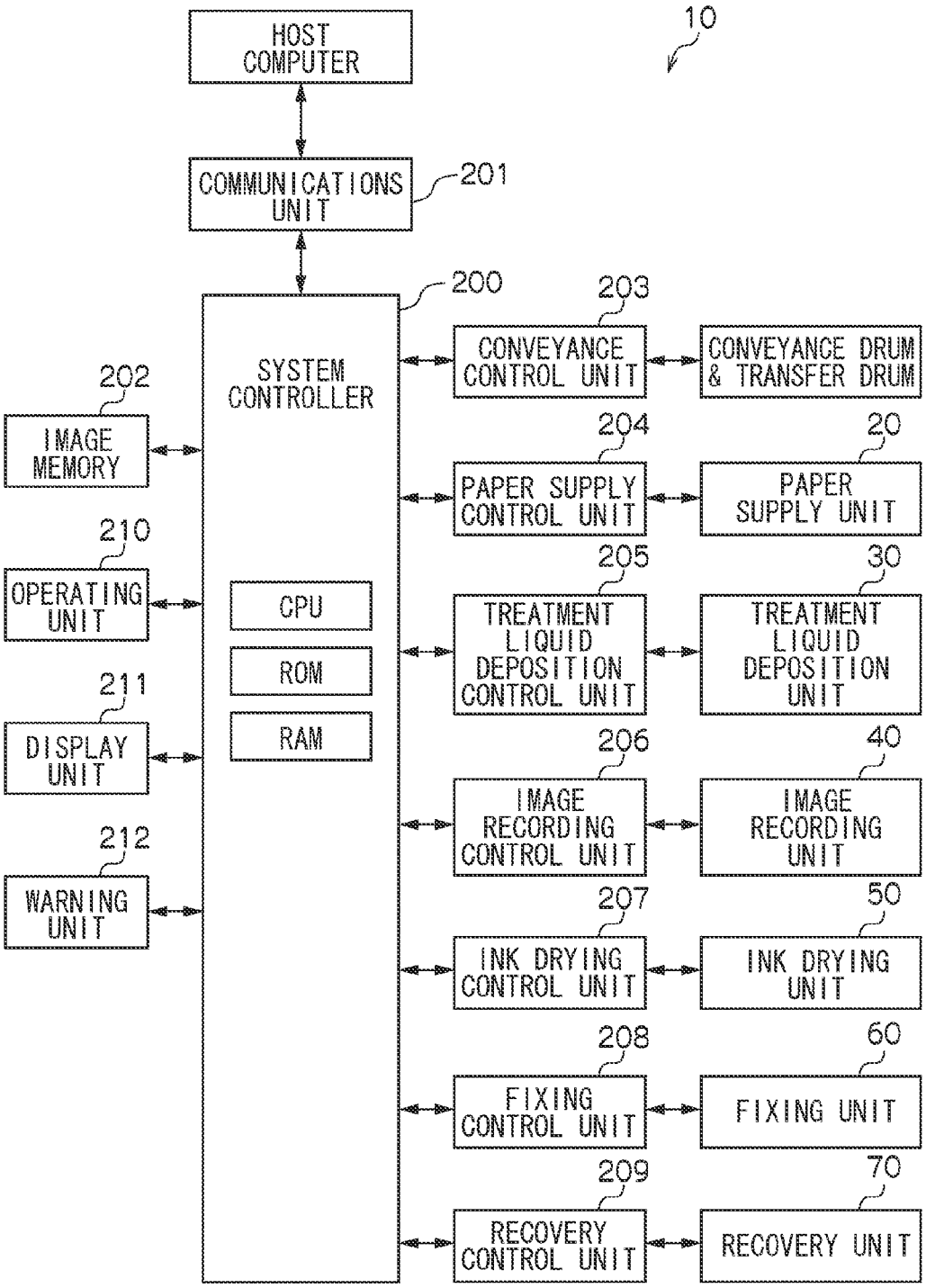
FIG. 2 is a block diagram showing the general composition of a control system of an inkjet recording apparatus.

FIG. 2 is a block diagram showing the approximate composition of a conveyance system of an inkjet recording apparatus 10 according to the present embodiment.

As shown in FIG. 2, the inkjet recording apparatus 10 includes a system controller 200, a communications unit 201, an image memory 202, a conveyance control unit 203, a paper supply control unit 204, a treatment liquid deposition control unit 205, an image recording control unit 206, an ink drying control unit 207, a fixing control unit 208, a recovery control unit 209, an operating unit 210, a display unit 211, a warning unit 212 and the like.

The system controller 200 functions as a control device which performs overall control of the respective units of the inkjet recording apparatus 10, and also functions as a calculation device which performs various calculation processes. This system controller 200 includes a CPU, ROM, RAM and the like, and operates in accordance with a prescribed control program. Control programs executed by the system controller 200 and various data necessary for control purposes are stored in the ROM.

The communications unit 201 includes a prescribed communications interface, and sends and receives data between the communications interface and a host computer connected to the communications interface.

The image memory 202 functions as a temporary storage device for various data including image data, and data is read from and written to the memory via the system controller 200. Image data which has been read in from the host computer via the communications unit 201 is stored in the image memory 202.

The conveyance control unit 203 controls the driving of the conveyance drums 31, 41, 51, 61 and the transfer drums 80, 90, 100, which are conveyance devices of the paper P in the treatment liquid deposition unit 30, the image recording unit 40, the ink drying unit 50 and the fixing unit 60.

More specifically, as well as controlling the driving of the motors which drive the conveyance drums 31, 41, 51, 61, the conveyance control unit 203 also controls the opening and closing of the grippers G which are provided on the conveyance drums 31, 41, 51, 61.

Similarly, the conveyance control unit 203 also controls the driving of the motors which drive the transfer drums 80, 90, 100, as well as controlling the opening and closing of the grippers G which are provided in the transfer drums 80, 90, 100.

Furthermore, since a mechanism for suctioning and holding the paper P on the circumferential surface is provided in each of the conveyance drums 31, 41, 51, 61, then the conveyance control unit 203 also controls the driving of the suctioning and holding mechanisms (in the present embodiment, since the paper P is suctioned by vacuum, then the conveyance control unit 203 controls the driving of the vacuum pump which forms a negative pressure generating device).

Moreover, the driers 84, 94, 104 are provided in the transfer drums 80, 90, 100, and therefore the conveyance control unit 203 also controls the driving (amount of heating and air flow volume) of these driers.

The driving of the conveyance drums 31, 41, 51, 61 and the transfer drums 80, 90, 100 is controlled in accordance with instructions from the system controller 200.

The paper supply control unit 204 controls the driving of the respective units which constitute the paper supply unit 20 (the paper supply device 21, transfer drum 23, and the like), in accordance with instructions from the system controller 200.

The treatment liquid deposition control unit 205 controls the driving of the respective units (for example, the treatment liquid deposition apparatus 32) which constitute the treatment liquid deposition unit 30, in accordance with instructions from the system controller 200.

The image recording control unit 206 controls the driving of the respective units which constitute the image recording unit 40 (the paper pressing roller 42, inkjet heads 44C, 44M, 44Y, 44K, and the like) in accordance with instructions from the system controller 200.

The ink drying control unit 207 controls the driving of the respective units which constitute the ink drying unit 50 (for example, the ink drying apparatus 52, and the like), in accordance with instructions from the system controller 200.

The fixing control unit 208 controls the driving of the respective units which constitute the fixing unit 60 (for example, the heat rollers 62, 63, the in-line sensor 64, and the like), in accordance with instructions from the system controller 200.

The recovery control unit 209 controls the driving of the respective units (for example, the paper output conveyor 72, and the like) which constitute the recovery unit 70, in accordance with instructions from the system controller 200.

The operating unit 210 includes a required operating device (for example, operating buttons and a keyboard, a touch panel, or the like), and outputs operational information input from the operating device to the system controller 200. The system controller 200 executes various processing in accordance with the operational information input from the operating unit 210.

The display unit 211 includes a required display apparatus (for example, an LCD panel, or the like), and causes prescribed information to be displayed on the display apparatus in accordance with instructions from the system controller 200.

The warning unit 212 includes a warning light and a speaker, or the like, and carries out a required warning operation (flashing the warning light, issuing a warning sound from the speaker, or the like), in accordance with instructions from the system controller 200.

As described above, a paper floating detection apparatus 300 is provided in the image recording unit 40 and floating up of the paper P is detected. The detection result for floating of the paper P by the paper floating detection apparatus 300 is output to the system controller 200. When floating of the paper P is detected, the system controller 200 judges that a conveyance abnormality has occurred and instructs the conveyance control unit 203 to halt conveyance of the paper P, as well as instructing the warning unit 212 to issue a required warning operation.

As described above, image data to be recorded on the paper P is read into the inkjet recording apparatus 10 from the host computer via the communications unit 201 and is stored in the image memory 202. The system controller 200 generates dot data by carrying out required signal processing on the image data stored in the image memory 202, and records an image represented by this image data by controlling the driving of each inkjet head of the image recording unit 40 in accordance with the generated dot data.

In general, the dot data is generated by subjecting the image data to color conversion processing and halftone processing. The color conversion processing is processing for converting image data represented by sRGB, or the like (for example, RGB 8-bit image data) into ink volume data for each color of ink used by the inkjet recording apparatus 10 (in the present embodiment, ink volume data for the respective colors of C, M, Y, K). Halftone processing is processing for converting the ink volume data of the respective colors generated by the color conversion processing into dot data of respective colors by error diffusion processing, or the like.

The system controller 200 generates dot data of the respective colors by applying color conversion processing and halftone processing to the image data. An image represented by the image data is recorded on the paper by controlling the driving of the corresponding inkjet heads in accordance with the dot data for the respective colors thus generated.

Recording Operation

Next, a printing operation of the inkjet recording apparatus 10 described above will be explained.

When the system controller 200 outputs a paper supply instruction to the paper supply device 21, a sheet of paper P is supplied from the paper supply device 21 to the paper supply tray 22. The paper P supplied to the paper supply tray 22 is transferred to the treatment liquid deposition drum 31 of the treatment liquid deposition unit 30 via the transfer drum 23.

The paper P transferred onto the treatment liquid deposition drum 31 is conveyed along a prescribed conveyance path by the treatment liquid deposition drum 31, and in the course of this conveyance, the paper passes through the treatment liquid deposition apparatus 32 and treatment liquid is deposited on the recording surface of the paper P.

The paper P on which treatment liquid has been deposited is transferred from the treatment liquid deposition drum 31 to the transfer drum 80, conveyed on a prescribed conveyance path by the transfer drum 80, and then transferred to the image recording drum 41 of the image recording unit 40. In the course of conveyance by the transfer drum 80, a hot air flow is blown onto the recording surface from the drier 84 which is disposed inside the transfer drum 80, and the treatment liquid which has been deposited on the recording surface is dried.

The paper P transferred from the transfer drum 80 to the image recording drum 41 is firstly nipped by the paper pressing roller 42 by passing the paper pressing roller 42, thereby causing the paper to make close contact with the outer circumferential surface of the image recording drum 41. Thereupon, the presence or absence of floating up of the paper P is detected by the paper floating detection apparatus 300. Here, if floating up of the paper P is detected, it is determined that a conveyance abnormality of the paper P has occurred, and the conveyance is halted and a required warning is issued. On the other hand, if floating up of the paper P is not detected, then the conveyance is continued without alteration and ink droplets of the respective colors of CMYK are ejected from the respective inkjet heads 44C, 44M, 44Y, 44K. By this means, a color image is recorded on the recording surface. The paper P on which an image has been formed is subsequently received onto the transfer drum 90 from the image recording drum 41.

The paper P which has been transferred to the transfer drum 90 is conveyed on a prescribed conveyance path by the transfer drum 90, and is transferred onto the ink drying drum 51 of the ink drying unit 50. In the course of this conveyance, a hot air flow is blown onto the recording surface from the drier 94 which is disposed inside the transfer drum 90, and the ink which has been deposited on the recording surface is dried.

The paper P which has been transferred to the ink drying drum 51 is conveyed along a prescribed conveyance path by the ink drying drum 51, and in the course of this conveyance, a hot air flow is blown onto the recording surface from the ink drying apparatus 52, thereby drying the liquid components remaining on the recording surface.

The paper P which has undergone the drying process is transferred from the ink drying drum 51 to the transfer drum 100, conveyed along a prescribed conveyance path, and transferred to the fixing drum 61 of the fixing unit 60. In the course of conveyance by the transfer drum 100, a hot air flow is blown onto the recording surface from the drier 104 which is disposed inside the transfer drum 100, thereby further drying the ink which has been deposited on the recording surface.

The paper P which has been transferred to the fixing drum 61 is conveyed along a prescribed conveyance path by the fixing drum 61, and in the course of this conveyance is heated and pressurized by the heat rollers 62, 63, thereby fixing the image formed on the recording surface. The paper P is then transferred onto the paper output conveyor 72 of the recovery unit 70 from the fixing drum 61, conveyed by the paper output conveyor 72 up to the stacker 71, and then output into the stacker 71.

As described above, in the inkjet recording apparatus 10 according to the present embodiment, the paper P is conveyed on drums and in the course of this conveyance, respective processes of treatment liquid deposition and drying, ejection of ink droplets, drying, and fixing are carried out on the paper P, thereby recording a prescribed image on the paper P.

Paper Floating Detection Apparatus

Embodiments of the paper floating detection apparatus are described below.

First Embodiment

Composition

As described above, in the inkjet recording apparatus 10 according to the present embodiment, a paper floating detection apparatus 300 is incorporated into the image recording unit 40, and floating up of the paper P is detected before ejection of ink droplets.

Figure 3:
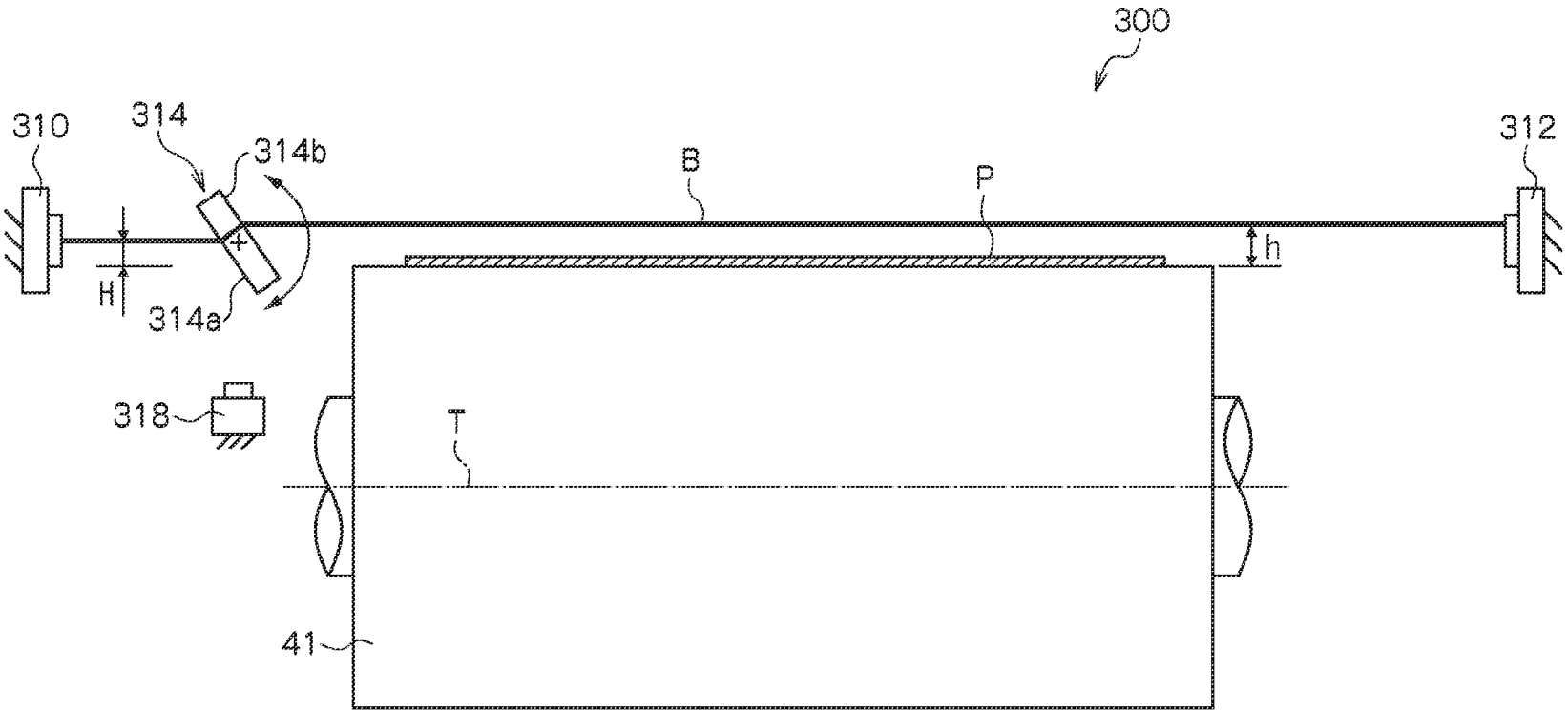
FIG. 3 is a front view diagram of a first embodiment of a paper floating detection apparatus.
Figure 4:
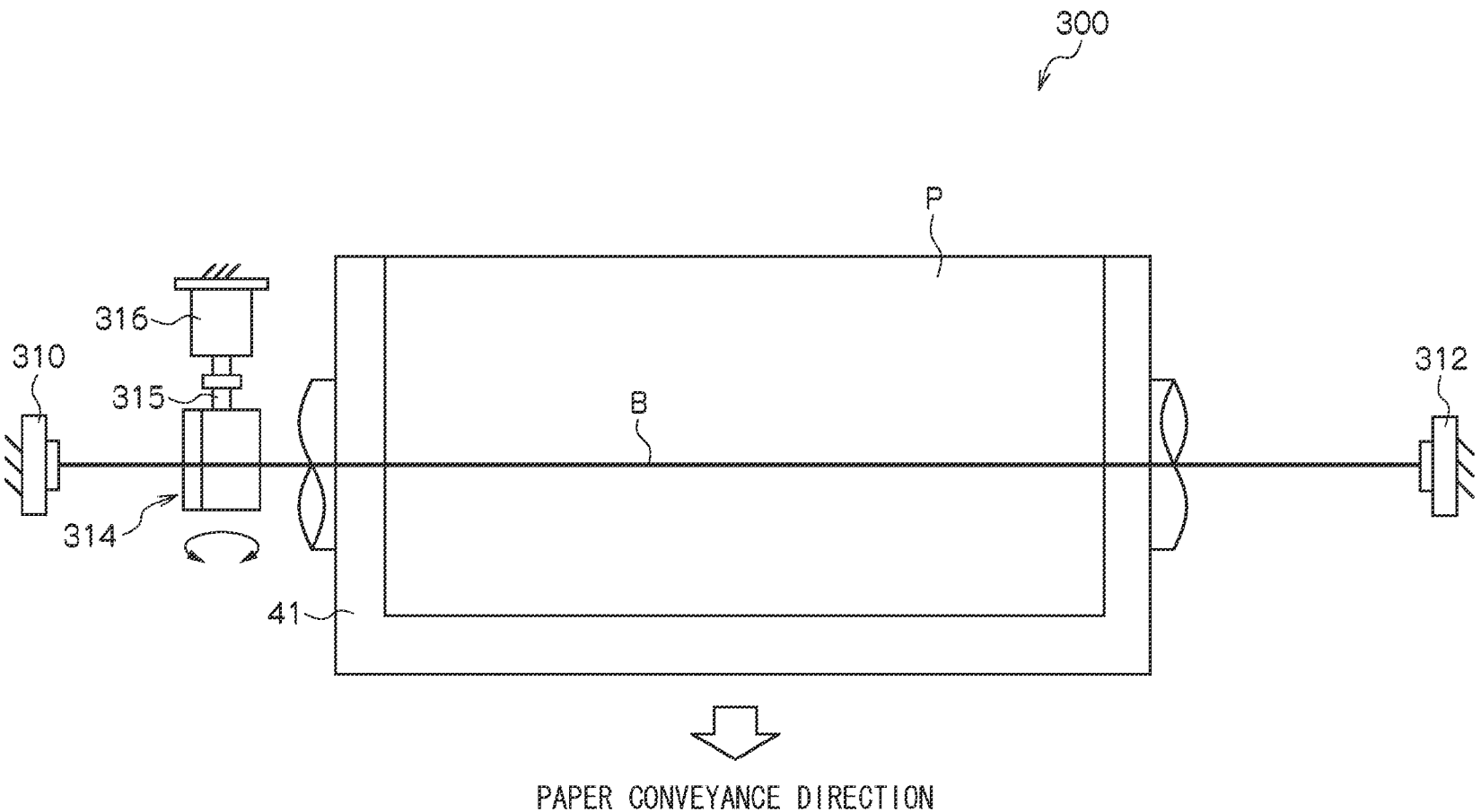
FIG. 4 is a plan view diagram of the first embodiment of the paper floating detection apparatus.

FIGS. 3 and 4 are, respectively, a front view diagram and a plan diagram of a first embodiment of the paper floating detection apparatus.

As shown in FIGS. 3 and 4, the paper floating detection apparatus 300 includes a light emission unit 310 which emits a detection beam (laser light) B, a light reception unit 312 which receives the detection beam B emitted from the light emission unit 310, a parallel flat glass plate for light emission 314 which is disposed in front of the light emission unit 310, a light emission motor 316 which drives and rotates the parallel flat glass plate for light emission 314, and a light emission start position detection sensor 318 which detects a start position of the parallel flat glass plate for light emission 314.

The light emission unit 310 and the light reception unit 312 constitute a paper floating detection device which detects floating of the paper P. The light emission unit 310 and the light reception unit 312 are arranged so as to be mutually opposing via the image recording drum 41 (namely, so as to be mutually opposing via the conveyance path of the paper P).

The light emission unit 310 is installed on the main body frame of the inkjet recording apparatus 10 via a bracket, which is not illustrated. This light emission unit 310 includes a light emitting element and emits a detection beam B from the light emitting element toward the light reception unit 312.

Here, the detection beam B is emitted in parallel with the axis of rotation T of the image recording drum 41 (namely, perpendicularly with respect to the conveyance direction of the paper P), as well as being emitted so as to pass through a position at a prescribed height H from the outer circumferential surface (conveyance surface) of the image recording drum 41. Therefore, the light emission unit 310 is arranged so as to satisfy these conditions.

The system controller 200 controls the driving of the light emission unit 310 so as to control the emission of the detection beam B.

The light reception unit 312 is installed on the main body frame of the inkjet recording apparatus 10 via a bracket, which is not illustrated. The light reception unit 312 includes a light receiving element (for example, a transmissive photoelectric element), and the detection beam B emitted from the light emission unit 310 is received by this light receiving element. The light receiving element is provided so as to oppose the light emitting element of the light emission unit 310 and receives the detection beam B which is emitted from the light emitting element in parallel with the axis of rotation T of the image recording drum 41 and in a position at a prescribed height H from the outer circumferential surface of the image recording drum 41.

The light reception information (amount of light received) of the detection beam B obtained by the light reception unit 312 is output to the system controller 200. The system controller 200 judges the presence or absence of floating of the paper P on the basis of the light reception information of the detection beam B obtained by the light reception unit 312. More specifically, the amount of light received is compared with a previously specified threshold value, and if the amount of light received is equal to or lower than the threshold value, then it is judged that the detection beam B has been shielded by the paper P and hence it is judged that floating of the paper P has occurred.

The parallel flat glass plate for light emission 314 is constituted by a rectangle-shaped transparent glass plate having an incident face 314*a* and an emission face 314*b*, these faces being mutually parallel. This parallel flat glass plate for light emission 314 is arranged in front of the light emission unit 310 (between the light emission unit 310 and the image recording drum 41), and is provided rotatably about a rotational axle 315 disposed on a side face of the parallel flat glass plate for light emission 314 on the upstream side in terms of the direction of conveyance of the paper P. The rotational axle 315 of the parallel flat glass plate for light emission 314 is arranged so as to lie in parallel with the conveyance surface of the paper P (here, in parallel with the direction of the tangent to the image recording drum 41 at the point of passage of the detection beam B), as well as being perpendicular to the detection beam B which is emitted from the light emission unit 310. Furthermore, the parallel flat glass plate for light emission 314 is arranged in such a manner that the detection beam B emitted from the light emission unit 310 is incident approximately in the center of the incident face 314*a* thereof.

The detection beam B emitted from the light emission unit 310 passes through the parallel flat glass plate for light emission 314 and is received by the light reception unit 312.

Here, when the incident face 314*a* of the parallel flat glass plate for light emission 314 is perpendicular to the detection beam B, then the detection beam B incident on the parallel flat glass plate for light emission 314 proceeds straight without alternation and exits from the emission face 314*b*. On the other hand, if the incident face 314*a* of the parallel flat glass plate for light emission 314 is inclined with respect to the detection beam B, then the light axis is shifted upward or downward by refraction (by an amount corresponding to the refractive index) and exits from the emission face 314*b*.

More specifically, by altering the angle of inclination of the parallel flat glass plate for light emission 314, it is possible to alter the height h of the detection beam B which passes above the image recording drum. Furthermore, the angle of inclination of the parallel flat glass plate for light emission 314 can be altered by rotating the parallel flat glass plate for light emission 314.

Figure 5:
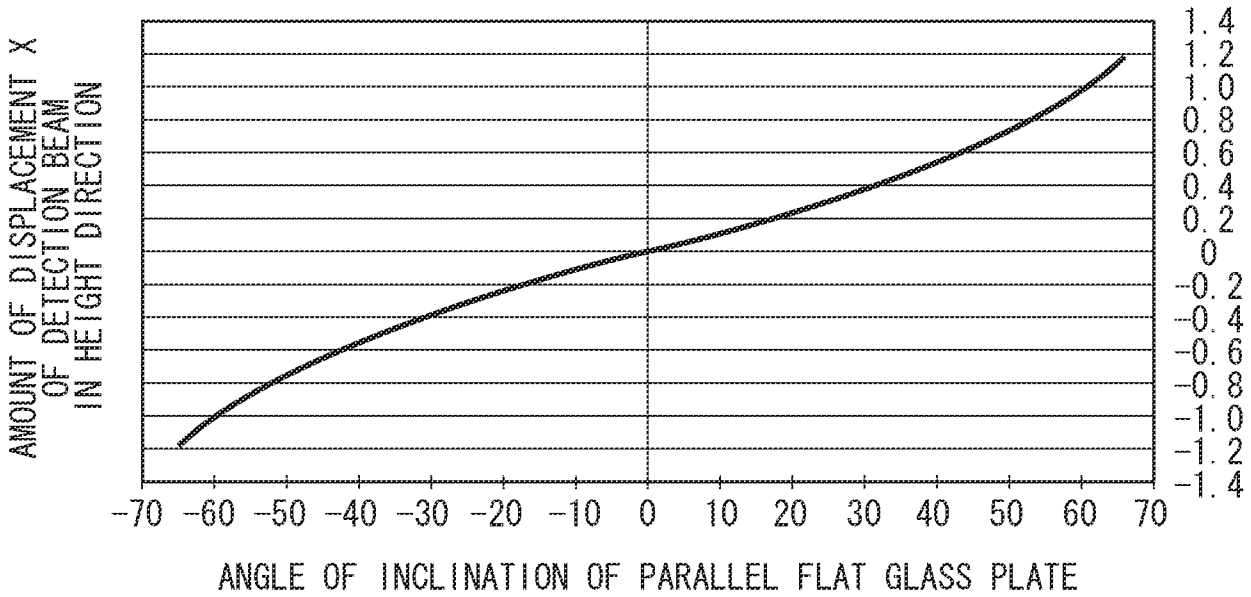
FIG. 5 is a graph showing the relationship between the angle of rotation (angle of inclination) of a parallel flat glass plate for light emission and the amount of displacement X in the height direction of a detection beam.

FIG. 5 is a graph showing the relationship between the angle of rotation (angle of inclination) of the parallel flat glass plate for light emission 314 and the amount X of displacement in the height direction of the detection beam.

In FIG. 5, the attitude which is perpendicular to the detection beam B is 0°, an angle of rotation in the counter-clockwise direction is positive (+) and an angle of rotation in the clockwise direction is negative (−).

As shown in FIG. 5, the position of the detection beam B is displaced upwards and downwards in accordance with the angle of rotation (angle of inclination) of the parallel flat glass plate for light emission 314.

Figure 6A:
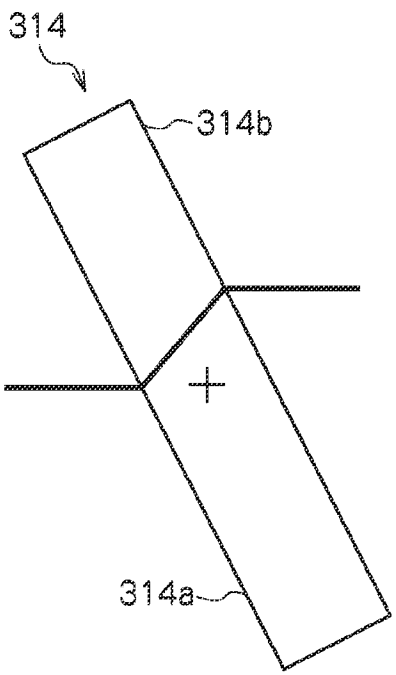
FIGS. 6A to 6C are diagrams showing the relationship between the angle of rotation (angle of inclination) of a parallel flat glass plate for light emission and the amount of displacement X in the height direction of a detection beam.
Figure 6B:
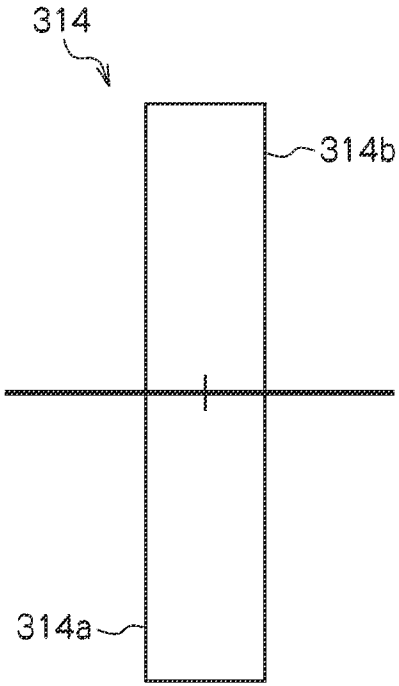
Figure 6C:
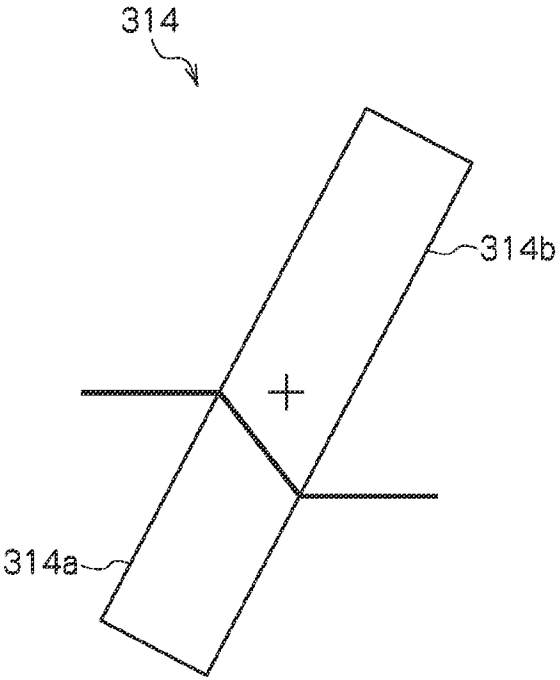

Therefore, as shown in FIGS. 6A, 6B and 6C, by adjusting the angle of rotation (angle of inclination) θ of the parallel flat glass plate for light emission 314, it is possible to adjust the height h of the detection beam B which passes above the image recording drum 41 (namely, the position of the detection beam B which is emitted from the emission face 314*b*). This height adjustment enables fine adjustment, as shown in FIG. 5 (has high resolution), and therefore highly accurate height adjustment can be performed.

The light emission motor 316 drives rotation of the parallel flat glass plate for light emission 314. This light emission motor 316 is constituted by a pulse motor which is capable of forward and reverse rotations, for example, and is installed on the main body frame of the inkjet recording apparatus 10 via a bracket, which is not illustrated. The parallel flat glass plate for light emission 314 is disposed in a prescribed position by being installed on the output shaft of the light emission motor 316. Therefore, by driving this light emission motor 316, it is possible to rotate the parallel flat glass plate for light emission 314 (in the forward direction or reverse direction).

The system controller 200 controls the driving of the light emission motor 316 so as to control the angle of rotation (angle of inclination) of the parallel flat glass plate for light emission 314 and hence the height h of the detection beam B.

A light emission start position detection sensor 318 detects that the parallel flat glass plate for light emission 314 is situated in a start position. In other words, this sensor 318 detects that the angle of inclination of the parallel flat glass plate for light emission 314 is 0° (that the incident face 314*a* of the parallel flat glass plate for light emission 314 is not inclined with respect to the detection beam B emitted from the light emission unit 310). The light emission start position detection sensor 318 is constituted by a proximity sensor (magnetic sensor, or the like), for example, and is arranged directly below the parallel flat glass plate for light emission 314 when the angle of inclination is 0°. A detection object (not illustrated) is installed on the lower surface portion of the parallel flat glass plate for light emission 314, and by detecting this detection object by means of the light emission start position detection sensor 318, it is detected that the angle of inclination of the parallel flat glass plate for light emission 314 is 0°. The output from the light emission start position detection sensor 318 is sent to the system controller 200, and the system controller 200 detects that the angle of inclination of the parallel flat glass plate for light emission 314 is 0°, on the basis of the output from the light emission start position detection sensor 318. In other words, the system controller 200 detects that the plate 314 is situated in a start position.

The composition of the light emission start position detection sensor 318 is not limited to this and it is also possible to use another composition. Furthermore, in the example described above, a composition is adopted in which detection is made in a non-contact fashion by using a proximity sensor, but it is also possible to adopt a composition in which detection is made using a contact type sensor.

Action

Next, the action of the paper floating detection apparatus 300 according to the present embodiment having the composition described above will be explained.

Floating of paper P is detected by emitting a detection beam B at a prescribed height from the conveyance surface of the paper P (namely, in the present embodiment, the outer circumferential surface of the image recording drum 41) and detecting whether or not the light is shielded by the paper P. The presence or absence of shielding by the paper P is judged on the basis of whether or not the detection beam B is received by the light reception unit 312. More specifically, if the detection beam B is shielded by the paper P, then the detection beam B ceases to be received by the light reception unit 312 and therefore, on this basis, it is detected that floating of the paper P has occurred.

Firstly, the detection height h0 for floating of the paper P is set. The detection height h0 for floating of the paper P is set to the sum of the thickness t of the paper P plus a predetermined floating tolerance value α (for example, assigned tolerance), (t+α).

The detection height h0 for floating of the paper P is set by setting the height of the detection beam which has passed through the parallel flat glass plate for light emission 314 (the detection beam having passed above the image recording drum 41) B to a position at a height of h0(=t+α) from the conveyance surface (the outer circumferential surface of the image recording drum 41).

Figure 7:
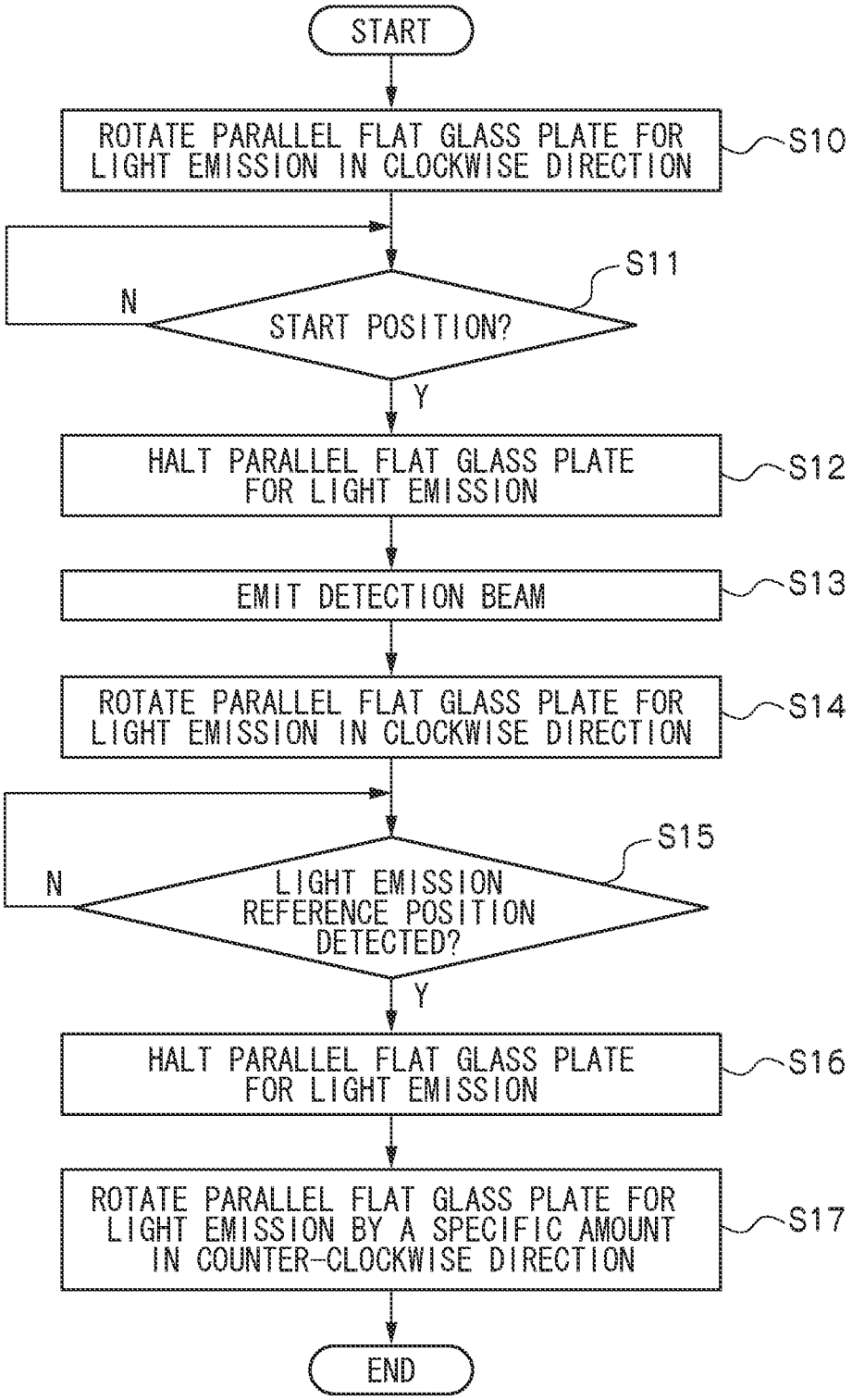
FIG. 7 is a flowchart showing steps for setting the detection height for floating of the paper.

FIG. 7 is a flowchart showing steps for setting the detection height for floating of the paper.

Firstly, the system controller 200 situates the parallel flat glass plate for light emission 314 at a start position.

This process is carried out by driving the light emission motor 316 to rotate the parallel flat glass plate for light emission 314 in one direction (the clockwise direction: CW), and detecting that the parallel flat glass plate for light emission 314 is situated in the start position by means of the light emission start position detection sensor 318.

Consequently, firstly, the system controller 200 drives the light emission motor 316 to turn the parallel flat glass plate for light emission 314 in the clockwise direction (CW) (step S10). The system controller 200 judges whether or not the parallel flat glass plate for light emission 314 has arrived at the start position on the basis of the output from the light emission start position detection sensor 318 (step S11). If it is judged that the parallel flat glass plate for light emission 314 has arrived at the start position, then the driving of the light emission motor 316 is halted, thereby halting the rotation of the parallel flat glass plate for light emission 314 (step S12). By this means, the parallel flat glass plate for light emission 314 is located in the start position.

Next, the system controller 200 causes the light emission unit 310 to emit a detection beam B (step S13). The detection beam B emitted from the light emission unit 310 passes through a position at a prescribed height H from the conveyance surface and is received by the light reception unit 312. In this state, the system controller 200 performs processing for detecting the conveyance surface, in other words, processing for locating the detection beam B in a reference position.

Firstly, the light emission motor 316 is driven and the parallel flat glass plate for light emission 314 is rotated in the clockwise direction (CW) (rotated in a direction whereby the detection beam B approaches the conveyance surface) (step S14). By this means, the height of the detection beam B is gradually reduced and at a certain point, the beam ceases to be received by the light reception unit 312. The system controller 200 judges whether or not the conveyance surface has been detected, and judges whether or not the detection beam B is located in the reference position, on the basis of the output from the light reception unit 312 (step S15). More specifically, when the detection beam B reaches the height of the conveyance surface, the detection beam B is shielded by the conveyance surface (in the present embodiment, shielded by the image recording drum 41), and therefore the system controller 200 judges whether or not the detection beam B is situated in the reference position (the position of the conveyance surface) by judging whether or not the detection beam B is received by the light reception unit 312. If it is judged that the detection beam B is positioned at the reference position, then the rotation of the parallel flat glass plate for light emission 314 is halted (step S16). By this means, the detection beam B is situated on the conveyance surface.

Next, the system controller 200 situates the detection beam B in a position at a detection height h0 from the reference position (the position of the conveyance surface). This process is carried out by driving the light emission motor 316 to rotate the parallel flat glass plate for light emission 314 by a specified amount in the counter-clockwise direction (CCW) (namely, to rotate the detection beam B by a specified amount in a direction away from the conveyance surface) (step S17). In other words, since the amount of rotation of the parallel flat glass plate for light emission 314 and the amount of displacement of the detection beam B are already known (see FIG. 5), the parallel flat glass plate for light emission 314 is rotated (in the counter-clockwise direction) by an amount whereby the detection beam B is situated in a position at a detection height h0 from the conveyance surface. By this means, the detection beam B is situated in a position at a detection height h0 from the conveyance surface.

By the series of steps described above, the setting of the detection height h0 for floating of the paper P is completed. Thereupon, detection can be performed.

As described above, floating of the paper P is detected on the basis of whether or not the detection beam B is received by the light reception unit 312. More specifically, if floating of the paper P occurs, then the detection beam B is shielded by the floating paper P, and therefore the detection beam B ceases to be received by the light reception unit 312 (the amount of received light becomes equal to or lower than a threshold value). The system controller 200 judges that floating of the paper P has occurred on the basis of the fact that the detection beam B has ceased to be received by the light reception unit 312, and implements a prescribed warning operation (flashing of a warning lamp, issuing of a warning sound from the speaker, or the like). Furthermore, the conveyance of paper P is halted simultaneously with this.

In this way, in the paper floating detection apparatus 300 according to the present embodiment, it is possible to alter the height of the detection beam B by rotating the parallel flat glass plate for light emission 314. By this means, it is possible to change the detection height h0 for floating of the paper P, in a simple fashion.

Furthermore, since a composition is adopted in which the detection beam B is displaced by an amount corresponding to the refractive index by rotating the parallel flat glass plate for light emission 314, then the height can be adjusted with high resolution and highly accurate height setting can be performed. By this means, it is possible to achieve highly accurate detection of floating.

Moreover, when setting the detection height h0, it is possible to adjust the height by detecting the conveyance surface, and therefore the detection height h0 can be set with good accuracy. Furthermore, it is also possible to achieve stable detection which is resistant to temporal change.

In the example described above, when setting the detection height h0 for floating of the paper P, the process of detecting the reference position is carried out only once, but desirably, this process is repeated a plurality of times. In other words, desirably, the process in steps S14 to S17 described above is repeated a plurality of times. By this means, it is possible to set the height with even higher accuracy.

Second Embodiment

Figure 8:
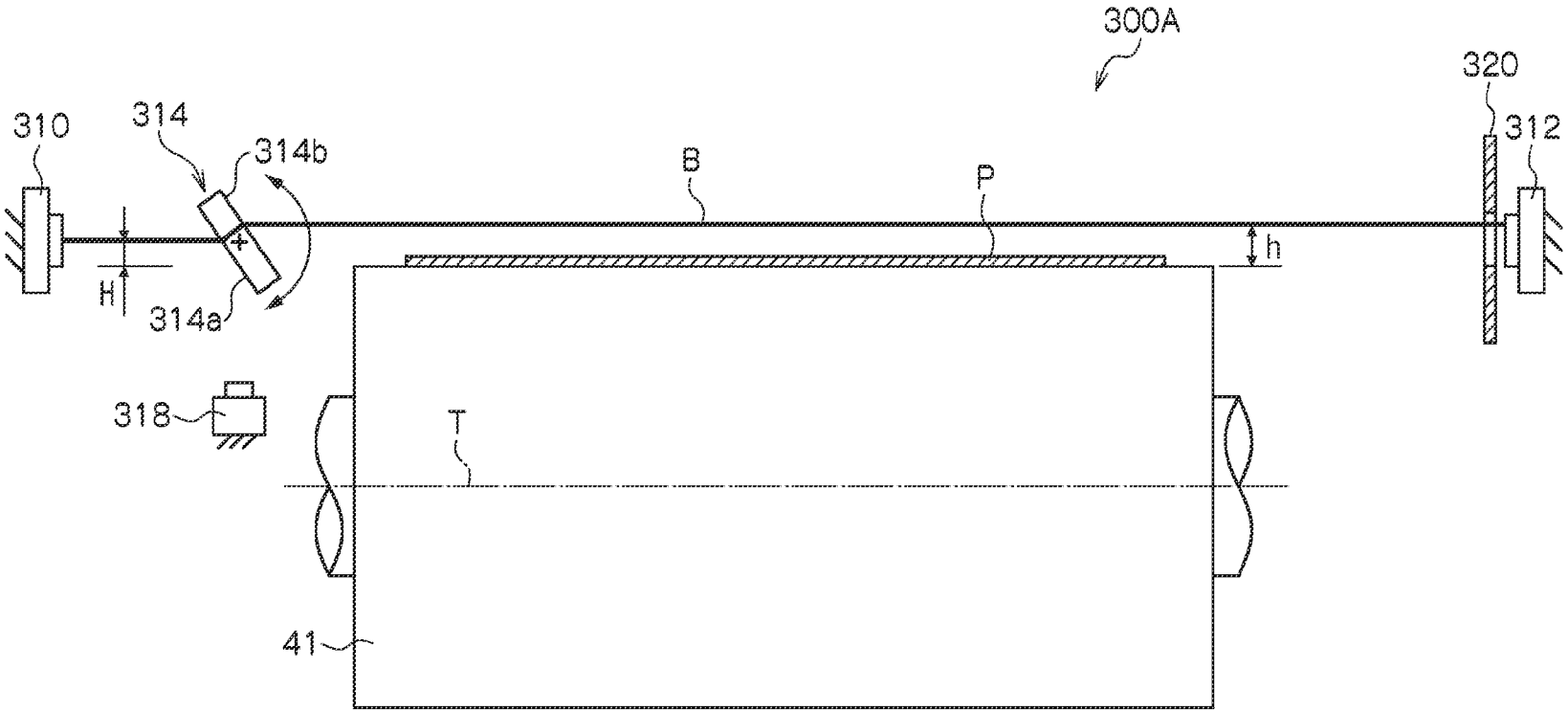
FIG. 8 is a front view diagram of a second embodiment of the paper floating detection apparatus.

FIG. 8 is a front view diagram of a second embodiment of the paper floating detection apparatus.

As shown in FIG. 8, in the paper floating detection apparatus 300A according to the present embodiment, a light reception aperture 320 having a prescribed opening is disposed in front of the light reception unit 312 (between the light reception unit 312 and the image recording drum 41). This light reception aperture 320 is fixed to a main body frame of the inkjet recording apparatus 10 via a bracket, which is not illustrated.

By disposing a light reception aperture 320 of this kind in front of the light reception unit 312, then even if a certain amount of discrepancy occurs between the positioning of the light emission unit 310 and the light reception unit 312, the position of the optical axis of the detection beam B can still be specified by the light reception aperture 320, and a highly robust structure can be achieved.

Figure 13:
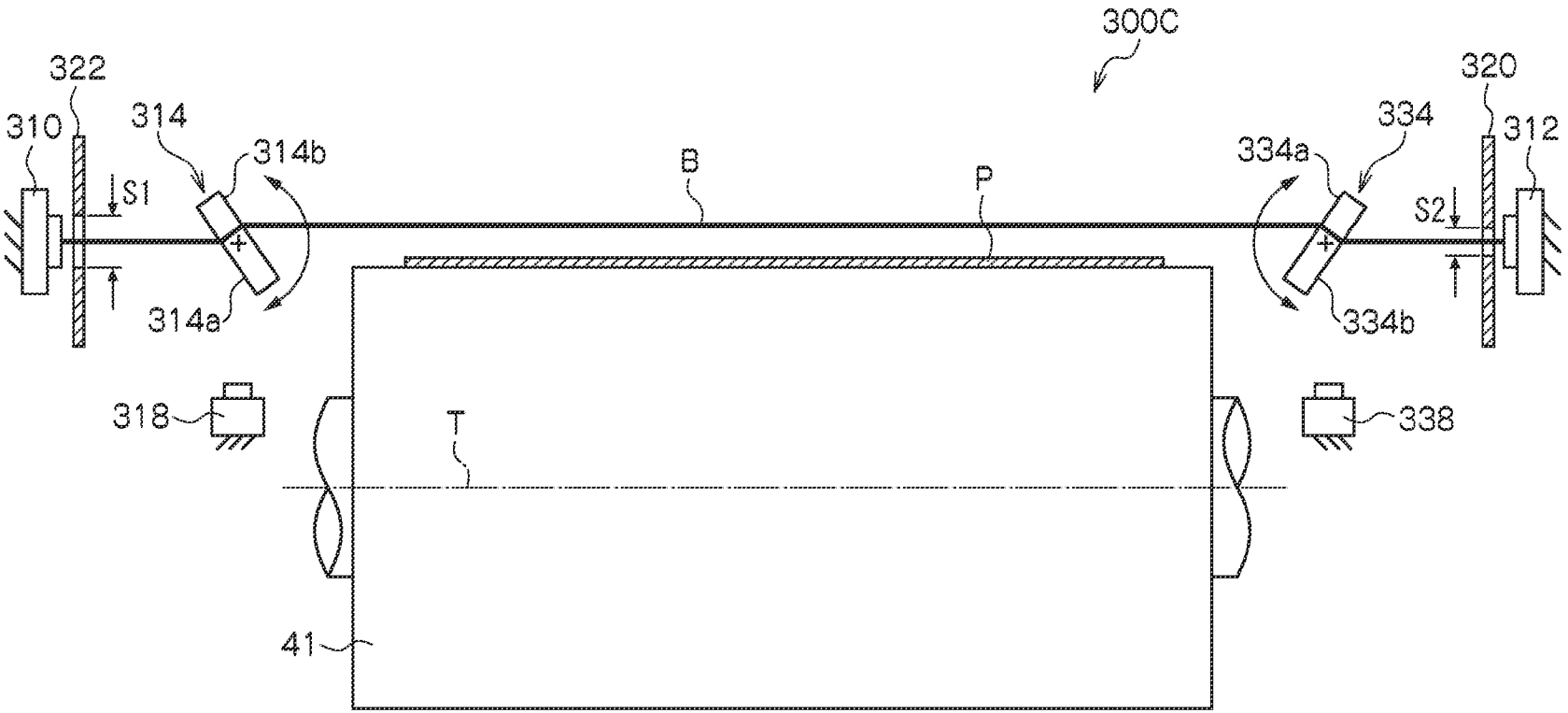
FIG. 13 is a front view diagram of a further embodiment of the paper floating detection apparatus.

In the present example, an aperture is provided only on the light reception side, but desirably, an aperture is disposed in a similar fashion on the light emission side (see FIG. 13). In other words, desirably, a light emission aperture is arranged in front of the light emission unit 310 (between the light emission unit 310 and the image recording drum 41). In this case, desirably, the opening surface area of the light reception aperture is smaller than the opening surface area of the light emission aperture. By this means, it is possible to extremely reduce the effects of the introduction of reflected light, and therefore detection of even higher accuracy can be performed.

Third Embodiment

Composition

Figure 9:
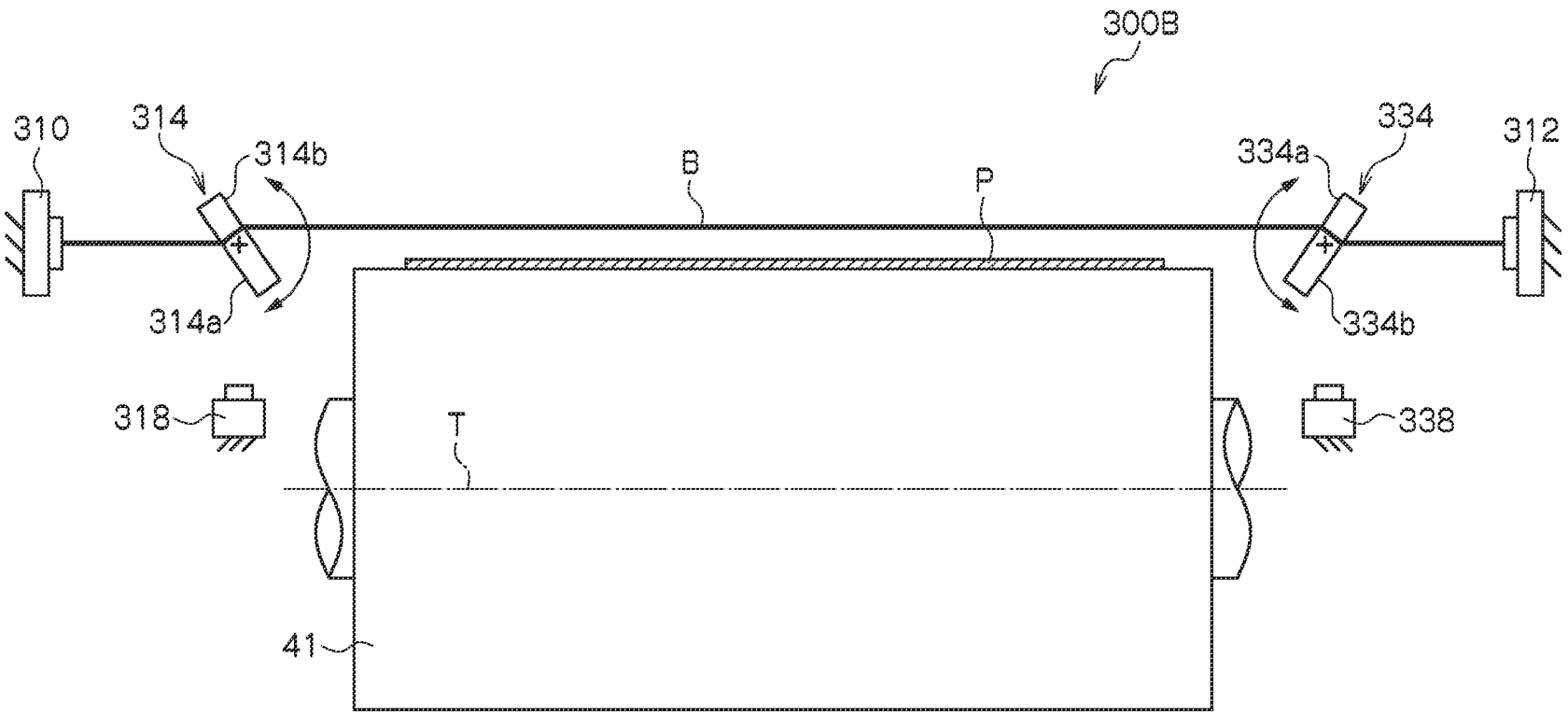
FIG. 9 is a front view diagram of a third embodiment of the paper floating detection apparatus.
Figure 10:
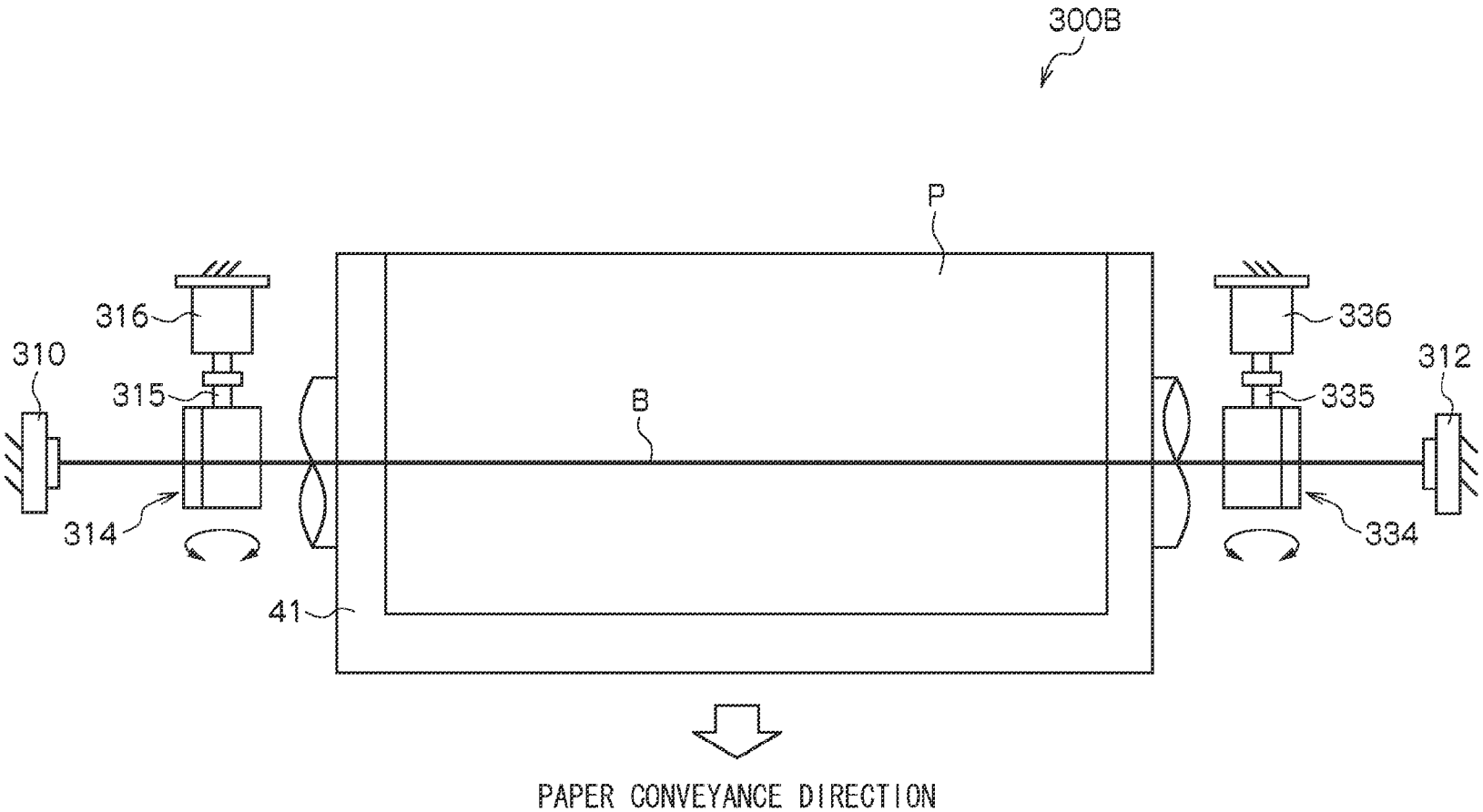
FIG. 10 is a plan view diagram of a third embodiment of the paper floating detection apparatus.

FIGS. 9 and 10 are, respectively, a front view diagram and a plan diagram of a third embodiment of the paper floating detection apparatus.

As shown in FIGS. 9 and 10, the paper floating detection apparatus 300B according to the present embodiment includes a parallel flat glass plate provided on the light reception side. Consequently, it is possible to adjust the position of the optical axis of the detection beam B on the light reception side as well.

The composition on the light emission side is the same as the composition of the first embodiment described above, and therefore only the composition on the light reception side is described here.

As shown in FIGS. 9 and 10, a parallel flat glass plate for light reception 334, a light reception motor 336 which drives the parallel flat glass plate for light reception 334 to rotate, and a light reception start position detection sensor 338 which detects the start position of the parallel flat glass plate for light reception 334 are provided in front of the light reception unit 312 (between the light reception unit 312 and the image recording drum 41).

The parallel flat glass plate for light reception 334, similarly to the parallel flat glass plate for light emission 314, is constituted by a rectangle-shaped transparent glass plate having an incident face 334*a* and an emission face 334*b*, these faces being mutually parallel. This parallel flat glass plate for light reception 334 is arranged in front of the light reception unit 312 (between the light reception unit 312 and the image recording drum 41), and is provided rotatably about a rotational axle 335 disposed on a side face of the parallel flat glass plate for light reception 334 to the upstream side in terms of the direction of conveyance of the paper P. The rotational axle 335 of the parallel flat glass plate for light reception 334 is arranged so as to lie in parallel with the conveyance surface of the paper P (here, in parallel with the direction of a tangent to the image recording drum 41 at the point of passage of the detection beam B), as well as being perpendicular to the detection beam B which is emitted from the light emission unit 310. Furthermore, the parallel flat glass plate for light reception 334 is also arranged in such a manner that the center of the emission surface 334*b* coincides substantially with the center of the light receiving surface of the light reception unit 312.

The detection beam B which has passed through the parallel flat glass plate for light emission 314 subsequently passes through the parallel flat glass plate for light reception 334 and is received by the light reception unit 312.

Here, when the incident face 334*a* of the parallel flat glass plate for light reception 334 is perpendicular to the detection beam B, then the detection beam B incident on the parallel flat glass plate for light reception 334 proceeds straight without alternation and exits from the emission face 334*b*. On the other hand, if the incident face 334*a* of the parallel flat glass plate for light reception 334 is inclined with respect to the detection beam B, then the light axis is shifted upward or downward by refraction (by an amount corresponding to the refractive index) and exits from the emission face 334*b*.

More specifically, by changing the angle of inclination of the parallel flat glass plate for light reception 334, it is possible to alter the height position of the detection beam B which is received by the light reception unit 312. Furthermore, the angle of inclination of the parallel flat glass plate for light reception 334 can be altered by rotating the parallel flat glass plate for light reception 334.

The light reception motor 336 drives rotation of the parallel flat glass plate for light reception 334. This light reception motor 336 is constituted by a pulse motor capable of forward and reverse rotations, for example, and is installed on the main body frame of the inkjet recording apparatus 10 via a bracket, which is not illustrated. The parallel flat glass plate for light reception 334 is disposed in a prescribed position by being installed on the output shaft of the light reception motor 336. Therefore, by driving this light reception motor 336, it is possible to rotate the parallel flat glass plate for light reception 334 (in the forward direction or reverse direction).

The system controller 200 controls the driving of the light reception motor 336 so as to control the angle of rotation (angle of inclination) of the parallel flat glass plate for light reception 334 and hence the height position of the detection beam B that enters the light reception unit 312.

The light reception start position determination sensor 338 determines that the parallel flat glass plate for light reception 334 is situated in a start position. In other words, this sensor 338 determines that the angle of inclination of the parallel flat glass plate for light reception 334 is 0° (that the incident face 334*a* of the parallel flat glass plate for light reception 334 is not inclined with respect to the detection beam B). The light reception start position determination sensor 338 is constituted by a proximity sensor (magnetic sensor, or the like), for example, and is arranged directly below the parallel flat glass plate for light reception 334 when the angle of inclination is 0°. A detection object (not illustrated) is installed on the lower surface portion of the parallel flat glass plate for light reception 334, and by detecting this detection object by means of the light reception start position determination sensor 338, it is determined that the angle of inclination of the parallel flat glass plate for light reception 334 is 0°. The output from the light reception start position determination sensor 338 is sent to the system controller 200, and the system controller 200 determines that the angle of inclination of the parallel flat glass plate for light reception 334 is 0°, on the basis of the output from the light reception start position determination sensor 338. In other words, the system controller 200 detects that the plate 334 is situated in a start position.

The composition of the light reception start position detection sensor 338 is not limited to this and it is also possible to use another composition. Furthermore, in the example described above, a composition is adopted in which detection is made in a non-contact fashion by using a proximity sensor, but it is also possible to adopt a composition in which detection is made using a contact type sensor.

Action

Next, the action of the paper floating detection apparatus 300B according to the present embodiment having the composition described above will be explained.

The method of detecting floating of the paper P is the same as in the paper floating detection apparatus 300 according to the first embodiment described above (namely, determining whether or not the detection beam B is shielded by the floating of paper P), and therefore the method of setting the detection height for floating of the paper P is described here.

Similarly to the paper floating detection apparatus 300 of the first embodiment described above, the detection height h0 for floating of the paper P is set to the sum of the thickness t of the paper P plus a predetermined floating tolerance value a (for example, assigned tolerance), $(t+\alpha)$.

Figure 11:
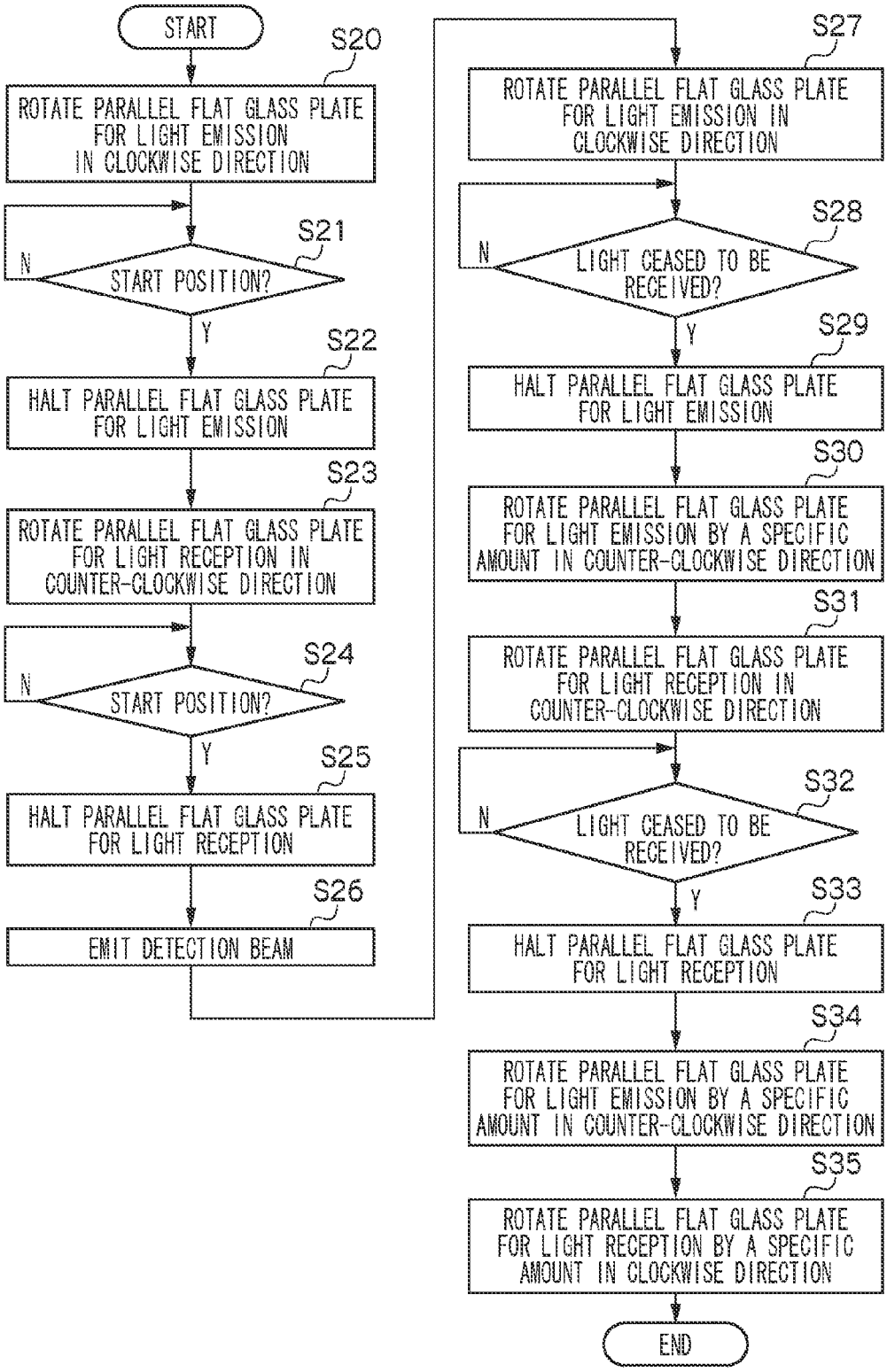
FIG. 11 is a flowchart showing steps for setting the detection height for floating of the paper.

FIG. 11 is a flowchart showing steps for setting the detection height for floating of the paper.

Firstly, the system controller 200 situates the parallel flat glass plate for light emission 314 and the parallel flat glass plate for light reception 334 respectively at start positions.

Firstly, the system controller 200 drives the light emission motor 316 to turn the parallel flat glass plate for light emission 314 in the clockwise direction (CW) (step S20). The system controller 200 judges whether or not the parallel flat glass plate for light emission 314 has arrived at the start position on the basis of the output from the light emission start position detection sensor 318 (step S21). If it is judged that the plate 314 has arrived at the start position, then the driving of the light emission motor 316 is halted, thereby halting the rotation of the parallel flat glass plate for light emission 314 (step S22). By this means, the parallel flat glass plate for light emission 314 is located in the start position.

Thereupon, the system controller 200 drives the light reception motor 336 to turn the parallel flat glass plate for light reception 334 in the counter-clockwise direction (CCW) (step S23). The system controller 200 judges whether or not the parallel flat glass plate for light reception 334 has arrived at the start position on the basis of the output from the light reception start position detection sensor 338 (step S24). If it is judged that the plate 334 has arrived at the start position, then the driving of the light reception motor 336 is halted, thereby halting the rotation of the parallel flat glass plate for light reception 334 (step S25). By this means, the parallel flat glass plate for light reception 334 is located in the start position.

Next, the system controller 200 causes the light emission unit 310 to emit a detection beam B (step S26). The detection beam B emitted from the light emission unit 310 passes through a position at a prescribed height H from the conveyance surface and is received by the light reception unit 312.

Thereupon, the system controller 200 drives the light emission motor 316 to rotate the parallel flat glass plate for light emission 314 in the clockwise direction (CW) (in a direction whereby the detection beam B approaches the conveyance surface) (step S27). By this means, the height of the detection beam B is gradually reduced and at a certain point, the beam ceases to be received by the light reception unit 312. The system controller 200 judges whether or not the detection beam B has ceased to be received by the light reception unit 312, on the basis of the output from the light reception unit 312 (step S28). If it is judged that the detection beam B has ceased to be received by the light reception unit 312, then the rotation of the parallel flat glass plate for light emission 314 is halted (step S29).

Thereupon, the system controller 200 drives the light emission motor 316 and rotates the parallel flat glass plate for light emission 314 by a prescribed amount in the counter-clockwise direction (CCW) (by a prescribed distance in a direction whereby the detection beam B moves away from the conveyance surface) so that the detection beam B is received at the light reception unit 312 (step S30). By this means, the detection beam B is received again by the light reception unit 312.

Thereupon, the system controller 200 drives the light reception motor 336 to turn the parallel flat glass plate for light reception 334 in the counter-clockwise direction (CCW) (step S31). By this means, at a certain point, the detection beam B again ceases to be received by the light reception unit 312. The system controller 200 judges whether or not the detection beam B is received, on the basis of the output from the light reception unit 312 (step S32). If it is judged that the detection beam B has ceased to be received by the light reception unit 312, then the rotation of the parallel flat glass plate for light reception 334 is halted (step S33).

The system controller 200, taking the position where the detection beam B ceases to be received as a reference position (the position of the conveyance surface), rotates the parallel flat glass plate for light emission 314 by a specified amount in the counter-clockwise direction (CCW) (step S34) and also rotates the parallel flat glass plate for light reception 334 by a specified amount in the clockwise direction (CW) (step S35) so as to situate the detection beam B in a position at a prescribed detection height h0.

By the series of steps described above, the setting of the detection height h0 for floating of the paper P is completed. Thereupon, detection can be performed.

In this way, by arranging a parallel flat glass plate on the light receiving side as well and enabling adjustment of the height of the detection beam B, it is possible to detect floating of the paper P with even higher accuracy.

In the example described above, the process of detecting a reference position is performed only once, but desirably, this process is carried out a plurality of times. In other words, desirably, the process in steps S27 to S35 described above is repeated a plurality of times. By this means, it is possible to set the height with even higher accuracy.

Fourth Embodiment

Figure 12:
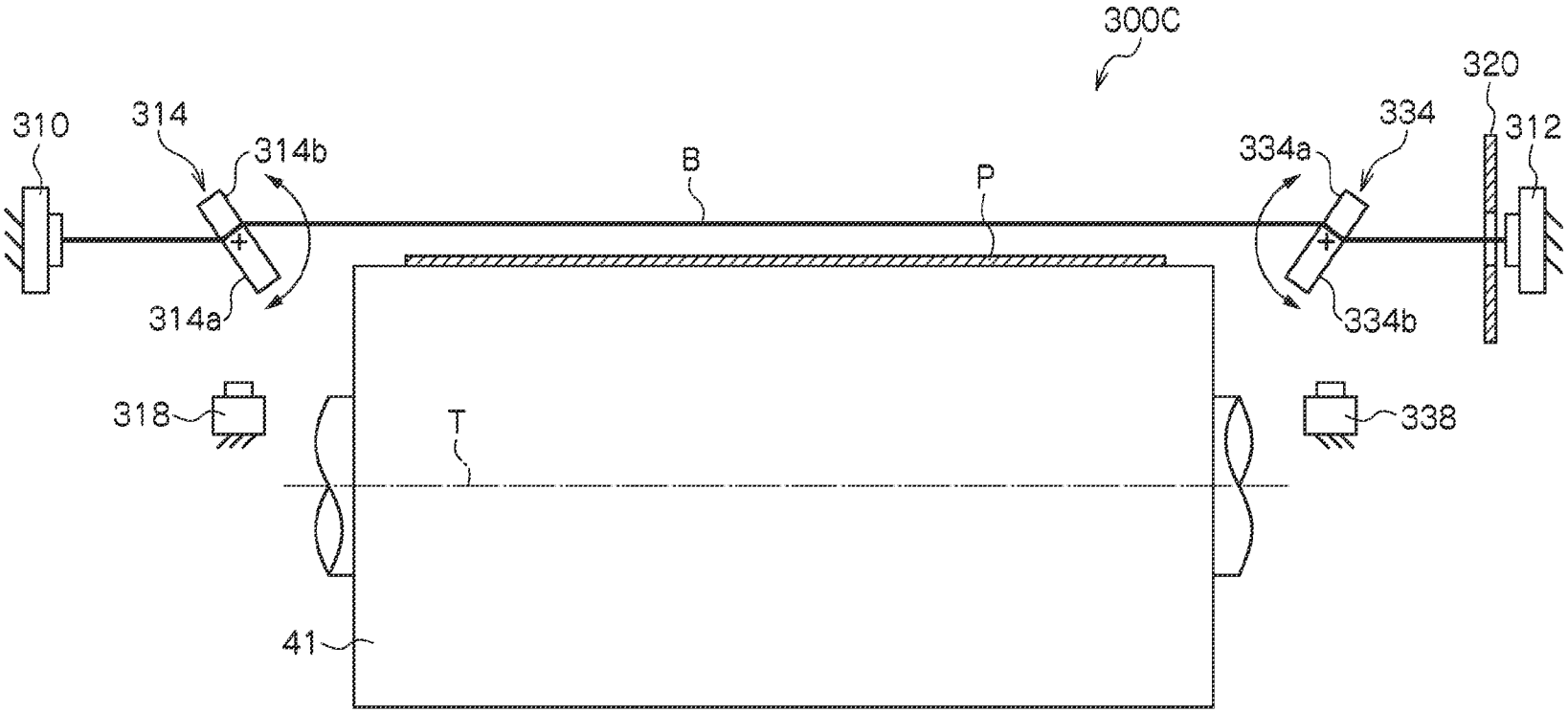
FIG. 12 is a front view diagram of a fourth embodiment of the paper floating detection apparatus.

FIG. 12 is a front view diagram of a fourth embodiment of the paper floating detection apparatus.

According to the paper floating detection apparatus 300C according to the present embodiment as shown in FIG. 12, a light receiving aperture 320 is further provided in front of the light reception unit 312 (between the light reception unit 312 and the parallel flat glass plate for light reception 334) in the paper floating detection apparatus 300B according to the third embodiment. This light reception aperture 320 is fixed to a main body frame of the inkjet recording apparatus 10 via a bracket, which is not illustrated.

By disposing a light reception aperture 320 of this kind in front of the light reception unit 312, then even if a certain amount of discrepancy occurs between the positioning of the light emission unit 310 and the light reception unit 312, the position of the optical axis of the detection beam B can still be specified by the light reception aperture 320, and a highly robust structure can be achieved.

In the present example, an aperture is provided only on the light reception side, but desirably, an aperture is disposed in a similar fashion on the light emission side (see FIG. 13). In other words, as shown in FIG. 13, a light emission aperture 322 is arranged in front of the light emission unit 310 (between the light emission unit 310 and the image recording drum 41). In this case, desirably, the opening surface area S2 of the light reception aperture 320 is smaller than the opening surface area S1 of the light emission aperture 322. By this means, it is possible to extremely reduce the effects of the introduction of reflected light, and therefore detection of even higher accuracy can be performed.

Fifth Embodiment

Figure 14:
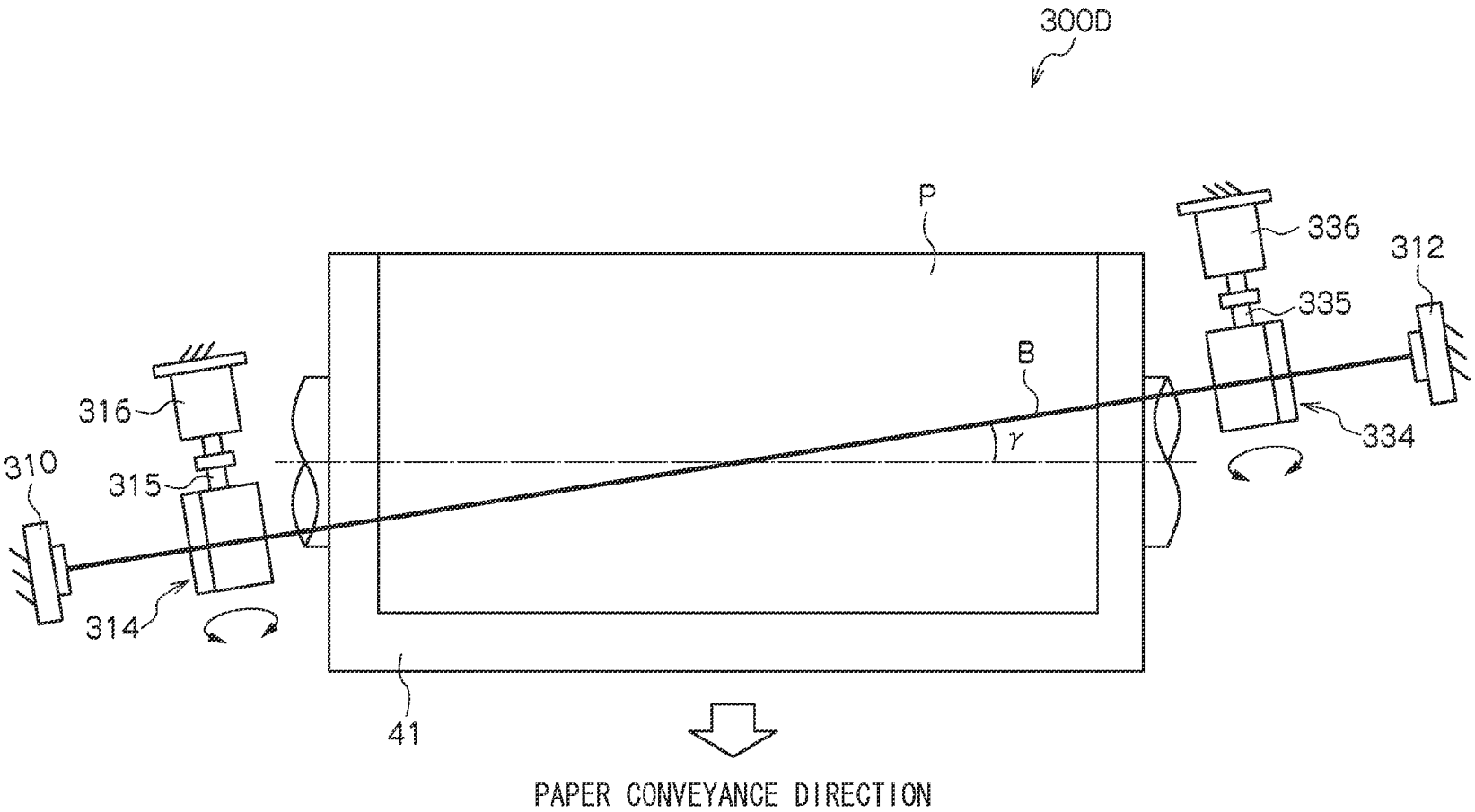
FIG. 14 is a plan view diagram of a fifth embodiment of the paper floating detection apparatus.

FIG. 14 is a plan view diagram of a paper floating detection apparatus according to a fifth embodiment.

As shown in FIG. 14, according to the paper floating detection apparatus 300D according to the present embodiment, a detection beam B is emitted at a prescribed angle of inclination (an inclination of 0.3° to 2°) with respect to a direction perpendicular to the conveyance direction of the paper P (namely, with respect to the axial direction of the image recording drum 41).

By inclining the detection beam B at a prescribed angle with respect to the direction perpendicular to the conveyance direction of the paper P in this way, it is possible to accurately detect the floating in the direction perpendicular to the conveyance direction of the paper P.

In this way, in the paper floating detection apparatus 300D according to the present embodiment, since the detection beam B is inclined at a prescribed angle with respect to the direction perpendicular to the conveyance direction of the paper P, then the light emission unit and the light reception unit, and the like, are disposed so as to be inclined at a prescribed angle with respect to the direction perpendicular to the conveyance direction of the paper P.

In the present embodiment, a composition is adopted in which the detection beam B is inclined in the composition of the paper floating detection apparatus 300B according to the third embodiment described above, but it is also possible to adopt a composition in which the detection beam B is inclined with respect to the direction perpendicular to the conveyance direction of the paper P in a paper floating detection apparatus according to another embodiment. In such a case, similar beneficial effects can be obtained.

Sixth Embodiment

As described above, in a paper floating detection apparatus according to a sixth embodiment, when setting the detection height for floating of paper P, a reference position (the position of the conveyance surface) is detected and the detection height for floating of the paper P is set by displacing the height of the detection beam B to a desired height position from the detected reference position. When detecting the reference position, the parallel flat glass plate for light emission 314 (and the parallel flat glass plate for light reception 334) are rotated in one direction from prescribed start positions, so as to detect the reference positions.

When the apparatus has been used for a long period of time, the assembly precision, or the like, declines, and there is a change in the amount of rotation (number of pulses) of the parallel flat glass plate for light emission 314 (and the parallel flat glass plate for light reception 334) that is required from the start position until the reference position is detected. Furthermore, when an abnormality has occurred in the apparatus, in a similar fashion, the assembly precision, or the like, declines, and there is a change in the amount of rotation (number of pulses) of the parallel flat glass plate for light emission 314 (and the parallel flat glass plate for light reception 334) that is required from the start position until the reference position is detected.

Therefore, the amount of rotation (number of pulses) of the parallel flat glass plate for light emission 314 (and the parallel flat glass plate for light reception 334) required from the start position until detection of the reference position is detected as a reference amount of rotation for light emission (and a reference amount of rotation for light reception), and this amount is compared with a threshold value (a previously established reference amount of rotation (reference number of pulses)), an abnormality being judged to have occurred in the apparatus if the reference amount of rotation for light emission (or the reference amount of rotation for light reception) exceeds the threshold value.

By this means, it is possible to detect an abnormality in the apparatus at an early stage and floating of the paper P can be detected in a stable fashion. If an apparatus abnormality is judged to have occurred, the system controller 200 implements a required warning operation. In response to this, an operator performs maintenance, cleaning, or the like.

In order to implement this composition, desirably, the light emission motor 316 (and the light reception motor 336) include a device for measuring the amount of rotation (in the case of a pulse motor, a device which counts the number of pulses). The system controller 200 detects the amount of rotation (number of pulses) of the parallel flat glass plate for light emission 314 (and the parallel flat glass plate for light reception 334) required from the start position until the reference position is detected, on the basis of the measurement results of the device for measuring the amount of rotation of the light emission motor 316 (and the light reception motor 336), and compares this amount of rotation with a threshold value (a previously established reference amount of rotation (number of reference pulses)) and judges that an apparatus abnormality has occurred if the detection amount of rotation exceeds the threshold value.

Seventh Embodiment

In the embodiments described above, a paper floating detection apparatus according to an embodiment of the present invention is incorporated into an image recording unit 40 of an inkjet recording apparatus 10 and detects floating of the paper P conveyed by an image recording drum 41.

The image recording drum 41 has a large thermal capacity and if the detection beam B is projected in the vicinity of this drum, and if air with a different temperature from outside, etc., passes through the optical axis of the detection beam B, then the optical axis of the detection beam B is deflected, and therefore the beam can no longer be detected or detection errors can occur.

Therefore, the system controller 200 either raises the detection height h0 for floating of the paper P or halts detection of floating of the paper P when the detection of floating of the paper P is not required, such as when the inkjet heads 44C, 44M, 44Y,d 44K are not situated over the image recording drum 41 (for example, when the inkjet heads 44C, 44M, 44Y, 44K have been withdrawn to a maintenance unit) or when paper P is not passing (for example, during maintenance of the inkjet heads 44C, 44M, 44Y, 44K). By this means, detection errors, and the like, are prevented and the inkjet recording apparatus can be operated in a stable fashion.

Further Embodiments

In the embodiments described above, examples are described in which a paper floating detection apparatus relating to an embodiment of the present invention is incorporated into an inkjet recording apparatus, but the application of the paper floating detection apparatus according to embodiments of the present invention is not limited to this. Embodiments of the present invention can also be applied to other recording apparatuses to incorporate a paper floating detection apparatus, and furthermore, can also be applied to apparatuses other than recording apparatuses.

Moreover, in the embodiments described above, an example is given in which floating of paper conveyed by a conveyance drum is detected, but the application of the present invention is not limited to this. The present invention can also be applied similarly to a case where paper is conveyed by another conveyance device. For example, the invention can also be applied similarly to a case of detecting floating of paper conveyed by a conveyance belt. Furthermore, the invention can also be applied similarly to a case where paper is conveyed by sliding over a prescribed conveyance surface, and not only cases where paper is conveyed while being held by suction or the like. For example, the invention can be applied to cases of detecting floating of paper conveyed over a platen.

In the embodiments described above, glass plates are used as the parallel flat plate for light emission and the parallel flat plate for light reception, but the material constituting the parallel flat plates is not limited to this. It is also possible to use parallel flat plates made from another material.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A paper floating detection apparatus which detects floating of paper conveyed along a prescribed conveyance path on a prescribed conveyance surface, the paper floating detection apparatus comprising:

a paper floating detection device which includes a light emission unit and a light reception unit disposed so as to be mutually opposing across the conveyance path, and detects whether the paper floats or not according to whether a detection beam emitted parallel to the conveyance surface from the light emission unit toward the light reception unit in a position at a prescribed height from the conveyance surface is received by the light reception unit or not;

a light emission parallel flat plate which is disposed in front of the light emission unit in such a manner that the detection beam emitted from the light emission unit passes through the light emission parallel flat plate, and which is provided rotatably about an axis parallel to the conveyance surface and perpendicular to the detection beam in such a manner that the height of the detection beam emitted from the light emission parallel flat plate after passing inside the light emission parallel flat plate varies according to rotation of the light emission parallel flat plate; and a light emission parallel flat plate rotation driving device which drives the rotation of the light emission parallel flat plate.

2. The paper floating detection apparatus as defined in claim 1, further comprising:

a light reception parallel flat plate which is disposed in front of the light reception unit in such a manner that the detection beam having passed through the light emission parallel flat plate passes through the light reception parallel flat plate, and which is provided rotatably about an axis parallel to the conveyance surface and perpendicular to the detection beam in such a manner that the height of the detection beam emitted from the light reception parallel flat plate after passing inside the light reception parallel flat plate varies according to rotation of the light reception parallel flat plate; and a light reception parallel flat plate rotation driving device which drives the rotation of the light reception parallel flat plate.

3. The paper floating detection apparatus as defined in claim 2, wherein an aperture for light reception is disposed between the light reception unit and the light reception parallel flat plate.

4. The paper floating detection apparatus as defined in claim 3, wherein an aperture for light emission is disposed between the light emission unit and the light emission parallel flat plate.

5. The paper floating detection apparatus as defined in claim 4, wherein an opening surface area of the aperture for light reception is set to be smaller than an opening surface area of the aperture for light emission.

6. The paper floating detection apparatus as defined in claim 2, further comprising a detection height adjustment device which controls driving of the light emission parallel flat plate rotation driving device and the light reception parallel flat plate rotation driving device according to a detection result of the paper floating detection device, so as to adjust the height of the detection beam, wherein the detection height adjustment device performs an operation of:

causing the light emission parallel flat plate to rotate in a first direction in a state where the detection beam is received by the light reception unit, and halting the rotation of the light emission parallel flat plate when the detection beam is no longer received by the light reception unit, and rotating the light emission parallel flat plate by a prescribed amount in a second direction which is opposite to the first direction, then causing the light reception parallel flat plate to rotate in the second direction, and halting the rotation of the light reception parallel flat plate when the detection beam is no longer received by the light reception unit, and employing, as reference positions, positions of the light emission parallel flat plate and the light reception parallel flat plate when the rotation of the light reception parallel flat plate is halted, and causing the light reception parallel flat plate to rotate by a prescribed amount from the reference position in the first direction and causing the light emission parallel flat plate to rotate by a prescribed amount from the reference position in the second direction so as to adjust the height of the detection beam.

7. The paper floating detection apparatus as defined in claim 6, wherein the detection height adjustment device starts the operation from a prescribed start position for light emission, and the paper floating detection apparatus further comprises:

a light emission reference rotation amount detection device which detects, as a light emission reference rotation amount, an amount of the rotation of the light emission parallel flat plate from the start position for light emission to the reference position; and an abnormality judgment device which compares the light emission reference rotation amount detected by the light emission reference rotation amount detection device with a threshold value so as to judge whether or not there is an apparatus abnormality.

8. The paper floating detection apparatus as defined in claim 6, wherein the detection height adjustment device starts the operation from a prescribed start position for light emission and a prescribed start position for light reception, and the paper floating detection apparatus further comprises:

a light emission reference rotation amount detection device which detects, as a light emission reference rotation amount, an amount of the rotation of the light emission parallel flat plate from the start position for light emission to the reference position;

a light reception reference rotation amount detection device which detects, as a light reception reference rotation amount, an amount of the rotation of the light reception parallel flat plate from the start position for light reception to the reference position; and an abnormality judgment device which compares the light emission reference rotation amount detected by the light emission reference rotation amount detection device with a threshold value and compares the light reception reference rotation amount detected by the light reception reference rotation amount detection device with a threshold value so as to judge whether or not there is an apparatus abnormality.

9. The paper floating detection apparatus as defined in claim 6, wherein the detection height adjustment device repeats the operation a plurality of times so as to adjust the height of the detection beam.

10. The paper floating detection apparatus as defined in claim 1, further comprising a detection height adjustment device which controls driving of the light emission parallel flat plate rotation driving device according to a detection result of the paper floating detection device, so as to adjust the height of the detection beam, wherein the detection height adjustment device performs an operation of:

causing the light emission parallel flat plate to rotate in a first direction in a state where the detection beam is received by the light reception unit, halting the rotation of the light emission parallel flat plate when the detection beam is no longer received by the light reception unit and employing, as a reference position, a position of the light emission parallel flat plate when the rotation of the light emission parallel flat plate is halted, and causing the light emission parallel flat plate to rotate by a prescribed amount from the reference position in a second direction which is opposite to the first direction so as to adjust the height of the detection beam.

11. The paper floating detection apparatus as defined in claim 10, wherein the detection height adjustment device starts the operation from a prescribed start position for light emission, and the paper floating detection apparatus further comprises:

a light emission reference rotation amount detection device which detects, as a light emission reference rotation amount, an amount of the rotation of the light emission parallel flat plate from the start position for light emission to the reference position; and an abnormality judgment device which compares the light emission reference rotation amount detected by the light emission reference rotation amount detection device with a threshold value so as to judge whether there is an apparatus abnormality.

12. The paper floating detection apparatus as defined in claim 10, wherein the detection height adjustment device repeats the operation a plurality of times so as to adjust the height of the detection beam.

13. The paper floating detection apparatus as defined in claim 1, wherein the light emission unit and the light reception unit are disposed in such a manner that the detection beam emitted from the light emission unit toward the light reception unit is inclined at a prescribed angle with respect to a direction perpendicular to a conveyance direction of the paper.

14. An inkjet recording apparatus comprising:

a conveyance device which conveys paper;

an inkjet head which ejects droplets of ink onto a recording surface of the paper conveyed by the conveyance device to form an image;

the paper floating detection apparatus as defined in claim 1 which is disposed on an upstream side of the inkjet head and detects the floating of the paper from the conveyance surface of the conveyance device; and a conveyance abnormality judgment device which judges a conveyance abnormality of the paper according to a detection result of the paper floating detection apparatus.

15. The inkjet recording apparatus as defined in claim 14, wherein the conveyance device is a conveyance drum which holds the paper by suction on an outer circumferential surface of the conveyance drum and conveys the paper by rotating.

16. The inkjet recording apparatus as defined in claim 15, wherein:

the inkjet head is provided movably between an image formation position where the droplets of ink are ejected onto the recording surface of the paper conveyed by the conveyance device to form the image and a withdrawn position where the inkjet head is withdrawn from the conveyance device, and the paper floating detection apparatus raises the height of the detection beam by a prescribed amount of height or halts detection, when the inkjet head is moved to the withdrawn position.

17. The inkjet recording apparatus as defined in claim 15, wherein the paper floating detection apparatus raises the height of the detection beam by a prescribed amount of height or halts detection, when recording is halted.

* * * * *